US012778239B2

(12) United States Patent
Orand et al.

(10) Patent No.: US 12,778,239 B2
(45) Date of Patent: Nov. 3, 2026

(54) SOLE STRUCTURE FOR AN ARTICLE OF FOOTWEAR

(71) Applicant: NIKE, Inc., Beaverton, OR (US)

(72) Inventors: Austin J. Orand, Portland, OR (US); Richard Kristian Hansen, Newberg, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/079,795

(22) Filed: Mar. 14, 2025

(65) Prior Publication Data

US 2025/0288059 A1 Sep. 18, 2025

Related U.S. Application Data

(60) Provisional application No. 63/565,280, filed on Mar. 14, 2024.

(51) Int. Cl.
*A43B 17/00* (2006.01)
*A43B 17/03* (2006.01)

(52) U.S. Cl.
CPC ..... *A43B 17/006* (2013.01); *A43B 17/03* (2013.01)

(58) Field of Classification Search
CPC ..... A43B 17/03; A43B 17/006
See application file for complete search history.

(56) References Cited

U.S. PATENT DOCUMENTS 2,090,881 A * 8/1937 Wilson ..... A43C 15/168 36/35 B
3,589,037 A * 6/1971 Gallagher ..... A43B 17/03 36/4
4,112,599 A 9/1978 Krippelz
4,625,436 A 12/1986 Stevens, Jr.
4,999,931 A * 3/1991 Vermeulen ..... A43B 13/185 36/153
5,551,173 A * 9/1996 Chambers ..... A43B 7/149 36/141
5,771,606 A * 6/1998 Litchfield ..... A43B 13/203 36/71

(Continued)

FOREIGN PATENT DOCUMENTS

AT 186553 B * 8/1956 ..... A43B 7/32
KR 100969814 B1 * 7/2010

(Continued)

OTHER PUBLICATIONS

International Search Report and Written Opinion dated Jun. 3, 2025, from International Patent Application No. PCT/US2025/019915, 13 pp.

*Primary Examiner* — Megan E Lynch
(74) *Attorney, Agent, or Firm* — Klarquist Sparkman, LLP

(57) ABSTRACT

An insole for an article of footwear can include a sheet comprising a plurality of domes that are spaced apart from one another and interconnected by a connecting portion of the sheet. The connecting portion extends between adjacent domes and around each dome. Each dome is deflectable from a first state where at least a peak of the dome protrudes in a first direction, away from the connecting portion and a first side of the sheet, to a second state where at least the peak protrudes in a second direction, away from the connecting portion and a second side of the sheet, where the second direction is opposite the first direction and the second side is opposite the first side.

20 Claims, 15 Drawing Sheets

(56) References Cited

U.S. PATENT DOCUMENTS 5,894,687 A * 4/1999 Lin ..... A43B 7/146 36/43
6,405,606 B1 6/2002 Walczyk et al.
6,434,859 B1 * 8/2002 Kim ..... A43B 7/142 36/43
6,976,321 B1 * 12/2005 Lakic ..... A43B 17/006 36/28
7,089,690 B2 * 8/2006 Krstic ..... A43B 23/028 36/3 R
7,132,032 B2 * 11/2006 Tawney ..... A43B 13/20 156/289
7,386,946 B2 * 6/2008 Goodwin ..... A43B 21/32 36/35 B
10,512,301 B2 * 12/2019 Peyton ..... A43B 13/04
2004/0086681 A1 * 5/2004 Wang ..... A43B 17/03 428/76
2007/0169376 A1 * 7/2007 Hatfield ..... A43B 7/1415 36/35 B
2008/0028642 A1 * 2/2008 Kim ..... A43B 13/20 36/140
2008/0041169 A1 2/2008 Walczyk et al.
2011/0277916 A1 * 11/2011 Beye ..... B29D 35/122 156/145
2013/0239443 A1 * 9/2013 Lin ..... A43B 7/08 36/3 B
2013/0276329 A1 * 10/2013 James ..... A43B 17/026 36/83
2014/0059885 A1 * 3/2014 Patchett ..... A43B 17/03 36/44
2018/0332925 A1 * 11/2018 Bailey ..... B32B 27/08
2023/0354959 A1 * 11/2023 Andrews ..... A43B 7/32

FOREIGN PATENT DOCUMENTS

KR 101250517 B1 * 4/2013
KR 101261375 B1 * 5/2013
KR 10-2023-0065757 11/2021
WO WO 99/32004 7/1999
WO WO 2018/014132 1/2018

* cited by examiner

SOLE STRUCTURE FOR AN ARTICLE OF FOOTWEAR

CROSS-REFERENCE TO RELATED APPLICATIONS

This application claims the benefit of U.S. Provisional Patent Application No. 63/565,280, filed Mar. 14, 2024, which is incorporated by reference herein in its entirety.

FIELD

This disclosure relates generally to articles of footwear and particularly to sole structures for articles of footwear.

BACKGROUND

An article of footwear typically includes two main components: a sole structure and an upper. The sole structure is configured for supporting the wearer's foot and providing cushioning between the wearer's foot and the ground. The sole structure may include an outsole that is adapted to contact the ground. The upper is coupled to the sole structure and is configured for securing the wearer's foot to the sole structure.

DETAILED DESCRIPTION

General Considerations

Figure 1:
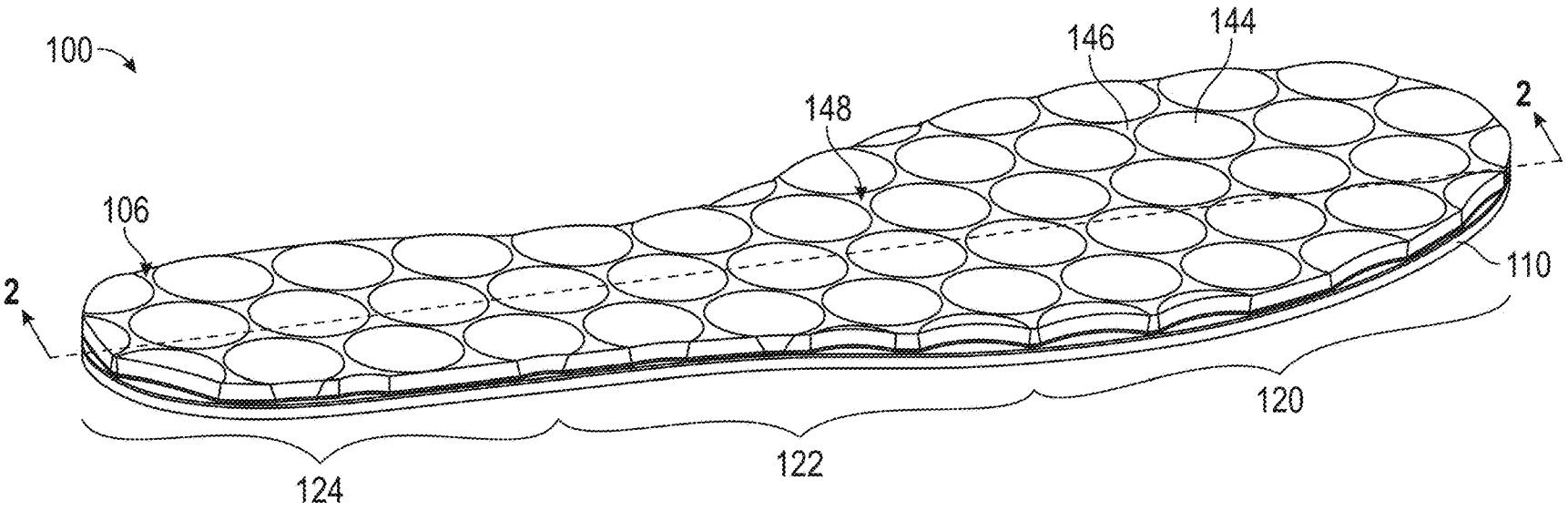
FIG. 1 is a perspective view of an exemplary insole for an article of footwear, where the insole comprises at least one dome that is configured to provide tactile feedback to a wearer.

The systems and methods described herein, and individual components thereof, should not be construed as being limited to the particular uses or systems described herein in any way. Instead, this disclosure is directed toward all novel and non-obvious features and aspects of the various disclosed examples, alone and in various combinations and subcombinations with one another. For example, any features or aspects of the disclosed examples can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application the singular forms "a," "an," and "the" include the plural forms unless the context clearly dictates otherwise. Additionally, the term "includes" means "comprises." Further, the term "coupled" or "secured" encompasses mechanical and chemical couplings, as well as other practical ways of coupling or linking items together, and does not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and methods. Additionally, the description sometimes uses terms like "provide," "produce," "determine," and "select" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

For purposes of this disclosure, portions of an article of footwear (and the various component parts thereof) may be identified based on regions of the foot located at or near that portion of the article of footwear when the footwear is worn on the properly sized foot. For example, an article of footwear and/or a sole structure may be considered as having a "forefoot region" at the front of the foot, a "midfoot" region at the middle or arch area of the foot, and a "heel region" at the rear of the foot. Footwear and/or sole structures also include a "lateral side" (the "outside" or "little toe side" of the foot) and a "medial side" (the "inside" or "big toe side" of the foot). The forefoot region generally includes portions of the footwear corresponding to the toes and the joints connecting the metatarsals with the phalanges. The midfoot region generally includes portions of the footwear corresponding with the arch area of the foot. The heel region generally corresponds with the rear portions of the foot, including the calcaneus bone. The lateral and medial sides of the footwear extend through the forefoot, midfoot, and heel regions and generally correspond with opposite sides of the footwear (and may be considered as being separated by a central longitudinal axis). These regions and sides are not intended to demarcate precise areas of footwear. Rather, the terms "forefoot region," "midfoot region," "heel region," "lateral side," and "medial side" are intended to represent general areas of an article of footwear and the various components thereof to aid the in discussion that follows.

For purposes of this disclosure, directional adjectives may be employed which correspond to the illustrated example. For example, the term "longitudinal" as used herein refers to a direction extending a length of an article. In some cases, the longitudinal direction may extend from a forefoot portion to a heel portion of the article. Also, the term "lateral" as used herein refers to a direction extending a width of an article. In other words, the lateral direction may extend between a medial side and a lateral side of an article. Furthermore, the term "vertical" as used herein refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, such as an upper and/or a sole structure.

As used herein, the term "exemplary" means serving as a non-limiting example, instance, or illustration. As used herein, the terms "e.g.," and "for example," introduce a list of one or more non-limiting examples, instances, and/or illustrations.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "articles of footwear" or "articles" mean any type of footwear, including, for example, basketball shoes, volleyball shoes, tennis shoes, running shoes, soccer shoes, football shoes, rugby shoes, baseball shoes, sneakers, hiking boots, sandals, socks, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

The Disclosed Technology

An article of footwear typically includes two main components: a sole structure and an upper. The sole structure is configured for supporting the wearer's foot and providing cushioning between the wearer's foot and the ground (e.g., the surface on which they are moving, walking, running, etc.). The upper is coupled to the sole structure and forms a foot-receiving cavity. The upper is configured for securing the wearer's foot to the sole structure and/or can protect the wearer's foot.

In some examples, the upper can include a strobel and the article of footwear can include an insole, with the insole disposed inside the upper and against the strobel. The insole can, in some examples, also be referred to as a sockliner.

While insoles can be designed to provide increased cushioning and support to the wearer's foot, it may also be beneficial for insoles to provide tactile feedback to the wearer and/or provide enhanced sensation to the bottom of the wearer's foot.

Disclosed herein are articles of footwear that comprise an insole (or sockliner) which provides tactile feedback or enhanced tactile sensation to the sole of the foot of the person wearing the article of footwear ("the wearer"). For example, the insole can include features that provide a tactile response to the wearer's sole, as the wearer puts weight against the insole and moves along a ground surface. In some examples, the insole can be configured to improve positional awareness and/or provide a fun and/or stimulating sensation to the wear's foot through stimulation of (such as popping against) the wearer's foot by the insole.

More specifically, described herein are insoles that can include one or more layers, including a layer configured as a sheet that comprises a plurality of domes that are spaced apart from one another and interconnected by a connecting portion of the sheet. Each dome is deflectable from a first state where at least a peak of the dome protrudes toward an inside of the article of footwear (e.g., toward the wearer's foot when the article of footwear is worn by an individual) and away from the connecting portion (in a first direction) to a second state where at least the peak protrudes toward a remainder of the sole structure and away from the connecting portion (in a second direction). In response to a force applied to the dome (e.g., from a wearer pressing or putting weight against the dome), each dome is configured to deflect from the first state to the second state. When the force is removed (e.g., the wearer takes weight off that portion of the insole, such as when picking their foot up off the ground), the dome snaps back to the first state from the second state.

In some examples, the wearer can experience two tactile sessions. The first sensation can be a haptic snapping sensation that occurs from depressing the dome or domes into a remainder of the insole and away from the inside of the article footwear (and the wearer's sole of their foot). The second sensation can be a second tactile or snapping sensation that occurs as the dome or domes rebound to their original state (the first state) when unloaded.

The bottom (or sole) of the foot is very sensitive. As a result, the domes of the insole can deliver tactile sensations to the wearer's foot that provide enhanced sensation and awareness. In some examples, this can allow the wearer to stay engaged during an activity (such as by providing a fidget tool). Wearing an article of footwear including such an insole can also be fun and provide a new experience to the wearer that is not found in articles of footwear that do not provide such targeted tactile responses. In some examples, such insoles can be used in articles of footwear used for athletic training. For examples, such insoles can be worn by an athlete to allow them to discover how they are weighting their feet during certain athletic activities (such as various sports).

In some examples, an insole for an article of footwear comprises a sheet comprising a plurality of domes that are spaced apart from one another and interconnected by a connecting portion of the sheet. The connecting portion extends between adjacent domes and around each dome. Each dome is deflectable from a first state where at least a peak of the dome protrudes in a first direction, away from the connecting portion, to a second state where at least the peak protrudes in a second direction, away from the connecting portion, where the first direction is toward an inside of the article of footwear.

In some examples, an insole for an article of footwear comprises a first layer comprising a plurality of domes spaced apart from one another across the first layer and a second layer disposed adjacent to the first layer. The second layer comprises a plurality of apertures spaced apart from one another. Each dome of the first layer is aligned with a corresponding aperture of the plurality of apertures of the second layer. Each dome has a an undeflected state where the dome protrudes outward and away from the corresponding aperture and a deflected state where the dome extends into the corresponding aperture.

In some examples, an insole for an article of footwear comprises a first layer comprising a plurality of spaced apart domes formed therein. Each dome is movable between a convex shape and a concave shape relative to an inward-facing side of the first layer that faces an interior of the article of footwear. The first layer comprises a polymer having an elasticity such that each dome is movable from the convex shape to the concave shape under a load and returns to the convex shape when the load is removed. The insole further comprises a second layer comprising foam. The second layer is disposed over the inward-facing side of the first layer. The second layer follows a contour of the plurality of spaced apart domes.

In some examples, an insole for an article of footwear comprises a first layer comprising a plurality of first domes spaced apart from one another across the first layer; and a second layer disposed adjacent to the first layer. The second layer comprises a plurality of second domes spaced apart from one another across the second layer, each second dome aligned with a respective first dome of the plurality of first domes; a connecting portion extending between and around the plurality of second domes; and a plurality of apertures extending through a thickness of the connecting portion, wherein each second dome is surrounded by one or more apertures of the plurality of apertures which define a respective cavity underneath the second dome having a depth defined by the thickness of the connecting portion. Each respectively aligned first dome and second dome has an undeflected state and a deflected state. The first and second domes protrude outward and away from the respective cavity in the undeflected state and the first and second domes extend into the respective cavity in the deflected state.

In some examples, an insole for an article of footwear comprises a first layer comprising a plurality of spaced apart first domes formed therein, where each first dome is movable between a convex shape and a concave shape relative to an inward-facing side of the first layer that faces an interior of the article of footwear, and where the first layer comprises a polymer having an elasticity such that each first dome is movable from the convex shape to the concave shape under a load and returns to the convex shape when the load is removed. The insole comprises a second layer comprising a connecting portion and a plurality of spaced apart second domes, where each second dome is connected to the connecting portion by one or more connectors that are defined by one or more apertures that are spaced apart around a perimeter of the second dome, where the one or more apertures extend through a thickness of the connecting portion and define a respective cavity underneath the second dome, and where each second dome is aligned with a respective first dome of the plurality of first domes and is movable, with the respective first dome, between a convex shape and a concave shape relative to an inward-facing side of the connecting portion of the second layer that faces the first layer. Each respective first dome and second dome are configured to extend into the respective cavity in their concave shapes, and wherein the second layer is configured to attenuate sound as each first dome moves between the convex and concave shape.

Additional examples of the disclosed technology are described below with reference to the accompanying drawings.

Examples of the Disclosed Technology

Figure 2:
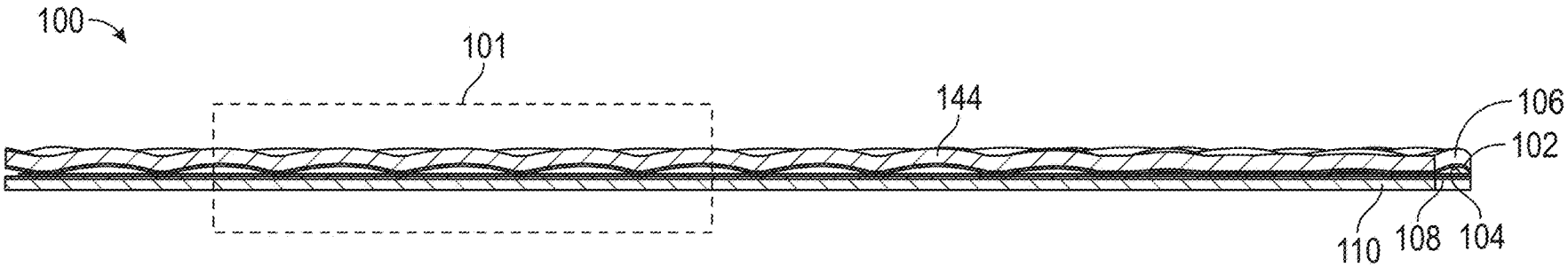
FIG. 2 is a cross-sectional side view of the insole of FIG. 1.
Figure 3A:
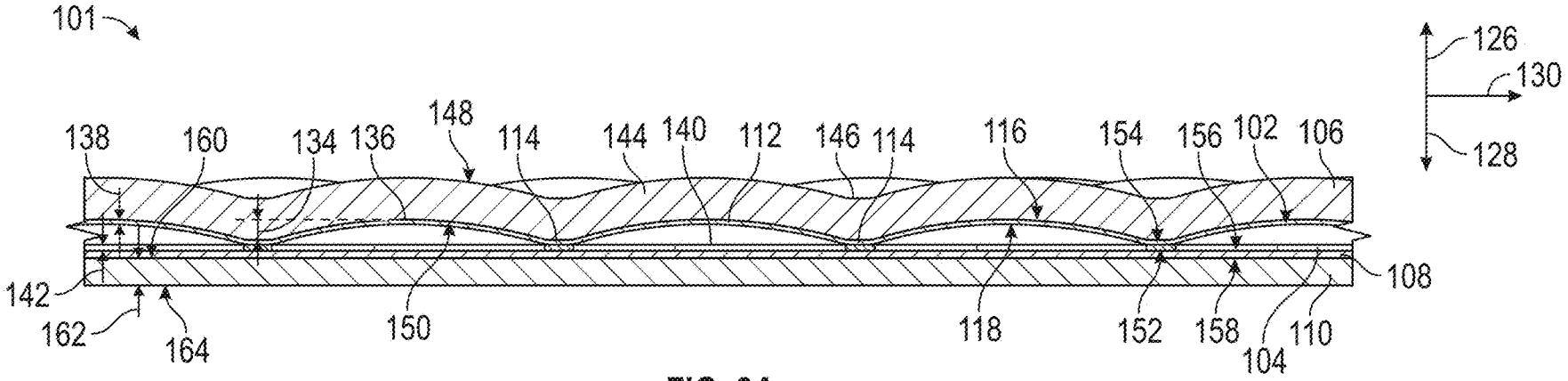
FIG. 3A is a detail view of a selected portion of the cross-sectional view of FIG. 2 with the deflectable domes of the insole in a first state.
Figure 3B:
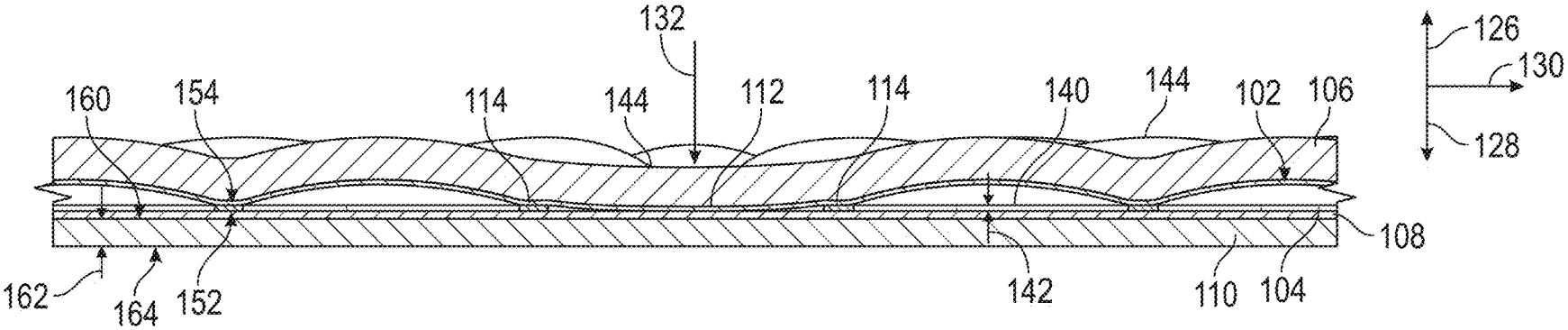
FIG. 3B is a detail view of the selected portion of the cross-sectional view of FIG. 2 with the deflectable domes of the insole in a second state.
Figure 4:
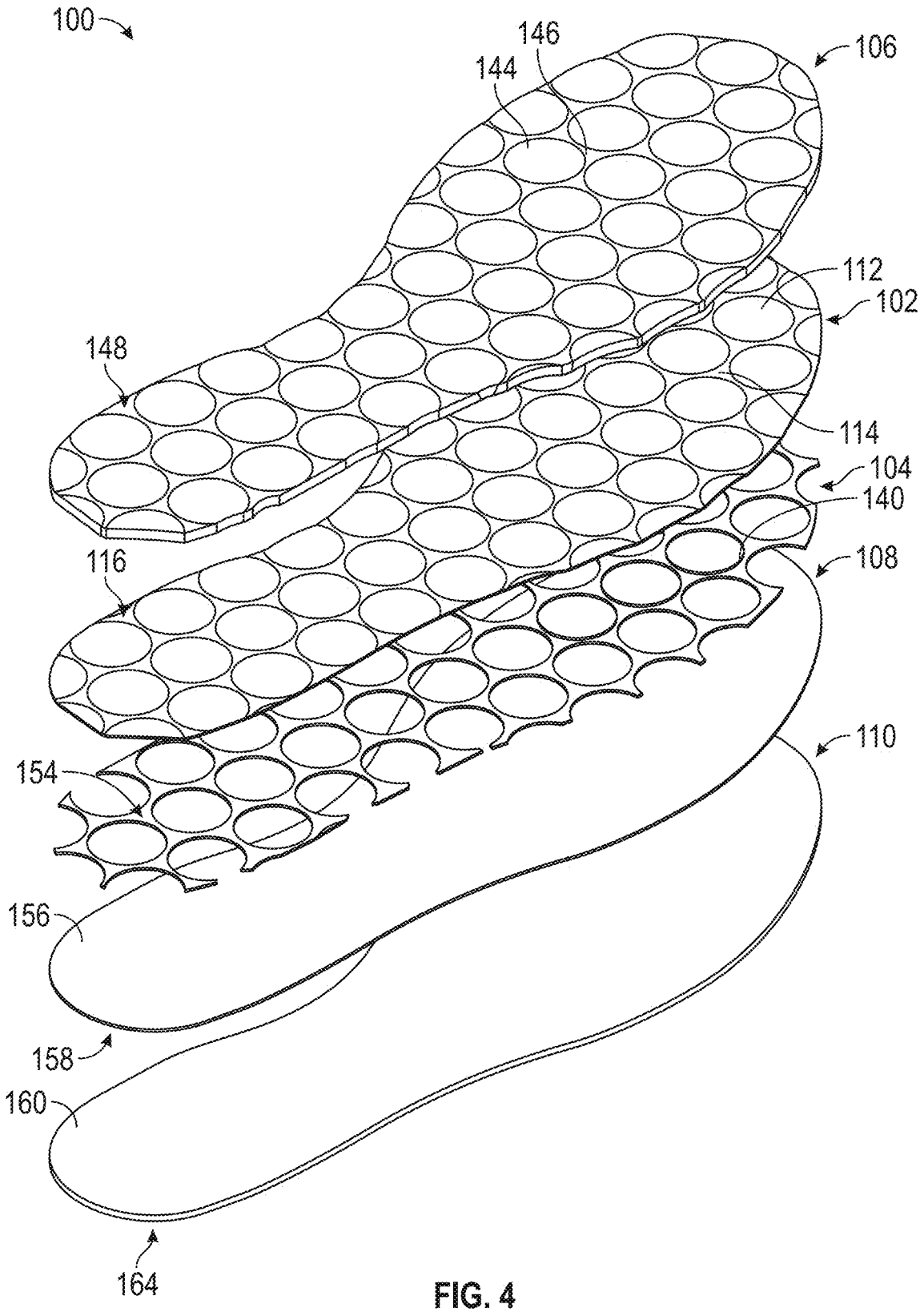
FIG. 4 is an exploded view of the insole of FIG. 1.

FIGS. 1-4 show an insole 100 for an article of footwear (such as the article of footwear 400 shown in FIG. 11, as described further below). The insole 100 can include one or more layers. In some examples, as shown in FIGS. 1-4, the insole 100 includes a plurality of stacked layers. FIG. 1 shows a perspective view of the assembled insole 100, FIG. 2 shows a cross-sectional side view of the assembled insole 100, and FIG. 4 shows an exploded view of the insole 100. FIG. 3A shows a detail view of a selected portion 101 of the cross-sectional view of FIG. 2.

As used herein, an "inward-facing surface" or "inward-facing side" of a layer (or sheet) can be the surface or side that faces an interior of the article of footwear (e.g., the cavity formed by the upper) and the wearer's foot when the article of footwear is being worn by the wearer. As such, in some examples, the inward-facing surface can instead be referred to as a foot-facing surface. An "outward-facing surface" or "outward-facing side" of a layer (or sheet) can be the surface or side that faces away from the interior of the article of footwear and toward a remainder of the sole structure (such as the outsole). In this way, an "outward-facing surface" or "outward-facing side" of the layer can face toward a ground surface when the article of footwear is being worn by the wearer. As such, in some examples, the outward-facing surface can be referred to as a ground-facing surface.

The insole 100 includes a first layer 102 comprising a plurality of domes 112 spaced apart from one another across the first layer 102 (as shown in FIG. 4). The first layer 102 further comprises a connecting portion 114 that extends between and around the plurality of domes 112. The connecting portion 114 can be continuous. In some examples, the connecting portion 114 can be referred to as being formed by a plurality of connecting segments that are continuous across the first layer 102.

In this way, each dome 112 can be surrounded (e.g., completely surrounded around its perimeter) by the connecting portion 114 (unless it is a dome 112 formed at the edge of the first layer 102, in which case it's interior side or edges are surrounded by the connecting portion 114).

The first layer 102 can also be referred to as a sheet comprising the plurality of domes 112 and the connecting portion 114. For example, the first layer 102 (or sheet) can comprise a continuous piece of material with the plurality of domes 112 formed therein. In this way, in some examples, the first layer 102 can be referred to as an integral component that is formed as one piece (e.g., molded as one piece).

In some examples, a spacing between adjacent domes 112 can vary. In some examples, the spacing between adjacent domes 112 can be within a range of 0.5-3 mm (or 10-30 mm measured from a center of one dome to a center of an adjacent dome). In some examples, the spacing between adjacent domes 112 can be about 2 mm (or 22 mm measured from a center of one dome to a center of an adjacent dome).

In some examples, the spacing between adjacent domes can be larger or smaller based on the material of the first layer 102 and/or based on desired density of domes across all or a portion of the first layer 102 that is dependent on a desired amount of position awareness or tactile feedback for the wearer.

In some examples, the plurality of domes 112 can extend across (or cover) an entire length and width of the insole 100.

In some examples, the plurality of domes 112 can extend across (or cover) at least a portion of the length and width of the insole 100. For example, in some instances, the domes 112 can be arranged in only a forefoot region 120, only midfoot region 122, only a heel region 124, or some combination thereof, of the insole 100.

Each dome 112 is deflectable between a first state (as shown in FIGS. 1-3A and 4) and a second state (as shown in FIG. 3B). The first state can be referred to as an undeflected state and the second state can be referred to as a deflected state. In the first state, at least a peak of the dome 112 protrudes (or extends) outward or away from the connecting portion 114, in a first direction 126 (as depicted in FIG. 3A). In the second state, at least the peak of the dome 112 protrudes (or extends) outward or away from the connecting portion 114, in a second direction 128 (as depicted in FIG. 3B). The first and second directions 126, 128 can be positive and negative vertical directions, which are perpendicular to a longitudinal direction 130, as depicted by the coordinate axis in FIGS. 3A and 3B.

When the insole 100 is arranged within an article of footwear (such as the article of footwear 400 shown in FIG. 11), the first direction 126 is toward an interior of the article of footwear (e.g., toward the wearer's foot when the article of footwear is worn by an individual) and the second direction 128 is toward a remainder of the sole structure of the article of footwear (such as the outsole).

In some examples, in the second state, at least the peak of the dome 112 is disposed flush with the connecting portion 114.

In some examples, in the second state, at least the peak of the dome 112 extends beyond the connecting portion 114 into an adjacent layer of the insole, as described further below.

Each dome 112 is deflectable from the first state to the second state in response to a force 132 (depicted schematically by an arrow in FIG. 3B) applied to the dome 112. The deflected dome 112 snaps back to the first state from the second state in response to removal of the force 132. The rebounding or "snapping back" of the dome 112 from the second state to the first state, upon removal of the force 132 (unloading of the dome 112), can deliver a first tactile sensation (or feedback) to the sole of the wearer's foot.

In some examples, the wearer can experience a second tactile sensation (e.g., a haptic snapping sensation) from depressing the dome 112 (or domes) from the first state into the second state (which depresses the dome 112 into a remainder of the insole 100 and away from the wearer's foot).

In this way, in some examples, the wearer can experience two tactile sensations, one when each dome 112 is depressed (into the second state), and another when each dome rebounds back to the first state after the force 132 is removed.

In some examples, the force 132 can be a force (e.g., body weight of the wearer) applied to the insole 100 as the wearer is walking, running, or otherwise moving around while wearing the article of footwear including the insole 100. Thus, as the wearer moves around, multiple domes 112 can be depressed at once and to varying degrees. For example, different magnitudes of force can be applied to different domes 112 in the first layer 102 based on how the wearer is moving and/or how they distribute their weight across the insole 100 as they are performing different activities. As a result, the domes 112 can provide feedback to the wearer as to how they are moving, distributing their weight, and the like, as they wear the article of footwear.

Returning to FIGS. 1-4, the first layer 102 can comprise an inward-facing side 116 (facing an interior of the article of footwear, as defined above) and an opposite, outward-facing side 118 (facing toward the outsole of the article of footwear, as defined above). In the first state of each dome 112, the dome 112 is convex relative to the inward-facing side 116 and concave relative to the outward-facing side 118. In the second state of each dome 112, the dome 112 is concave relative to the inward-facing side 116 and convex relative to the outward-facing side 118. In some examples, as used herein, the inward-facing or outward-facing sides of the different layers can also be referred to as first/second or inward/outward-facing surfaces of the layers.

Each dome 112 can have a diameter (or width) in a range of 10-30 mm, 15-25 mm, or 18-22 mm. In some examples, each dome 112 can have a diameter (or width) of about 20 mm.

Each dome 112 can have a height (when in the first state, or convex position) in a range of 0.5-2.0 mm, 1.3-1.7 mm, or 1.4-1.6 mm. In some examples, each dome 112 can have a height (when in the first state, or convex position) of about 1.5 mm. In some examples, the height of the domes 112 can vary based on a thickness of the first layer 102 and/or the diameter of the domes 112.

As depicted in FIG. 3A, the height 134 of a dome (in the first state) can be measured from the connecting portion 114 (on the inward-facing side 116 of the first layer 102) to a peak 136 (or apex) of the dome 112. Thus, when a dome 112 is depressed from the first state into the second state, it can be depressed by an amount that is at least the height 134 of the dome 112. In some examples, when a dome 112 is depressed from the first state into the second state, it can be depressed by an amount that is greater than the height 134 of the dome 112 due to apertures in the underlying second layer 104, as described further below.

In some examples, if a dome 112 is depressed partially (not into or fully into the respective aperture in the second layer 104), the resulting sensation to the wearer may be muted as compared to when the dome 112 is fully depressed into the aperture.

In some examples, the height and/or diameter of the domes 112 can vary across the first layer 102. For example, in some instances, at least one dome 112 can have a different height and/or diameter than another dome 112 in the first layer 102.

In some examples, all the domes 112 of the first layer 102 can have the same height, same diameter, or same height and same diameter.

In some examples, each dome 112 can have a height/diameter ratio (height-to-diameter ratio) within a range of 0.06-0.09, or about 0.075. In some examples, the height/diameter ratio of the domes 112 can vary based on the thickness of the material of the first layer 102.

The first layer 102 (or sheet) can comprise a polymeric material. In some examples, the polymeric material is polycarbonate. In some examples, the polymeric material can have a stiffness or elasticity that is configured such that each dome 112 is deflectable from the first state to the second state in response to a force applied to the dome 112, and each dome 112 snaps back to the first state from the second state in response to removal of the force.

In some examples, the material of the first layer 102 (such as the polymeric material) can be configured to have relatively high thermoformability (or ability to otherwise manufacture), high fatigue strength to increase durability, low creep to improve longevity of the tactile experience over life of the product, high stiffness to increase tactility, high impact strength for shape retention, and/or the like. The material can additionally or alternatively be configured for various environmental considerations, such as moisture, bonding, and temperature.

A thickness 138 (depicted in FIG. 3A) of the first layer 102 (or sheet) can be configured such that each dome 112 is deflectable from the first state to the second state in response to a force (e.g., the wearer's bodyweight) applied to the dome 112, and each dome 112 snaps back to the first state from the second state in response to removal of the force. In some examples, the thickness 138 of the first layer 102 can be in a range of 0.26-0.51 mm (0.01-0.02 inches) or 0.35-0.41 mm (0.014-0.016 inches). In some examples, the thickness 138 of the first layer 102 can be about 0.38 mm (0.015 inches).

In some examples, the first layer 102 is formed by vacuum forming the polymeric material.

The insole 100 can include a second layer 104. As shown in FIGS. 1-4, the second layer 104 is disposed adjacent to the first layer 102 within the insole 100. The second layer 104 is disposed against the outward-facing side 118 of the first layer 102 (specifically, the connecting portion 114 of the first layer 102). For example, an inward-facing side 154 (or surface) of the second layer 104 can be disposed against (in face-to-face contact with) the outward-facing side 118 of the connecting portion 114 of the first layer 102 (as shown in FIGS. 1-3B).

The second layer 104 comprises a plurality of apertures 140 spaced apart from one another (as shown in FIG. 4). For example, the second layer 104 can be a sheet of material with the spaced apart apertures 140 extending through a thickness of the second layer 104.

Each aperture 140 of the second layer 104 is aligned with a corresponding dome 112 of the first layer 102. For example, as shown in FIGS. 3A and 3B, when the first layer 102 and the second layer 104 are arranged against one another in the insole 100, each aperture 140 is disposed directly below a respective dome 112 (such that they are aligned in the longitudinal direction 130 and a lateral direction that is perpendicular to the longitudinal direction 130 and the vertical direction 126, 128).

For each dome 112, the dome 112 protrudes outward and away from the respective (or corresponding) aperture 140 in the first state (undeflected state) and the dome 112 extends into the respective aperture 140 in the second state (deflected state). When the dome 112 extends into the respective aperture 140 it extends beyond the connecting portion 114 (e.g., past center), thereby forming the concave shape relative to the inward-facing side 116 of the first layer 102.

In some examples, the second layer 104 can comprise a polymer. In some examples, the second layer 104 comprises polyethylene terephthalate glycol (PETG).

In some examples, the second layer 104 comprises rubber. Such a material may provide increased manufacturability and/or sound dampening as the domes 112 are depressed into and snap back out of the second layer 104.

The second layer 104 has a thickness that can be in a range of 0.38-1.5 mm (0.015-0.06 inches). In some examples, the second layer 104 has a thickness that can be about 0.51 mm (0.02 inches). The thickness of the second layer 104 can define a depth 142 of each aperture 140, which is configured to receive a respective dome 112 therein. As such, as the thickness of the second layer 104 increases, a larger perceptible sensation or tactile response to the wearer can be delivered during depression and release of the domes 112 into the apertures 140.

In some examples, the depth 142 of the apertures 140 is larger than the thickness 138 of the first layer 102.

In some examples, the depth 142 of the apertures 140 is the same or smaller than the thickness 138 of the first layer 102.

In some examples, the second layer 104 is formed by laser cutting.

In some examples, the second layer 104 can be formed by die cutting.

The insole 100 can include a third layer 106. In some examples, the third layer 106 can be an inner-most layer of the insole 100 (top-most layer shown in FIGS. 1-4). The third layer 106 is disposed against the inward-facing side 116 of the first layer 102. Specifically, an outward-facing side 150 (or surface) of the third layer 106 is disposed against (in face-to-face contact with) the inward-facing side 116 of the first layer 102.

The third layer 106 comprises a plurality of spaced apart domes 144 that follow a contour of the plurality of domes 112 of the first layer 102. For example, when the insole 100 is assembled (as shown in FIGS. 1-3B), each dome 144 of the third layer 106 can overlay or be disposed directly overtop a respective dome 112 of the first layer 102.

The third layer 106 can be formed from a single piece of material. As such, the plurality of domes 144 can be formed in the material of the third layer 106 and spaced apart by a connecting portion 146 of the third layer 106. Each dome 144 protrudes outward and away from the connecting portion 146 in an undeflected state (the first state of the domes 112). Said another way, the domes 144 can be raised relative to the connecting portion 146, on an inward-facing side 148 (or surface) of the third layer 106.

In some examples, the domes 144 of the third layer 106 can be formed by recesses in the outward-facing side 150 (such that the outward-facing side 150 follows a contour of the domes 112) and the inward-facing side 148 of the third layer 106 can be flat (instead of contoured). In this way, the inward-facing side 148 or surface of the third layer 106 can have the appearance of a standard sockliner.

In some examples, the third layer 106 comprises foam. As such, the third layer 106 can be compressible and provide cushioning (and/or comfort).

In some examples, the third layer 106 comprises foam covered by a top cloth (or textile) forming the inward-facing side 148.

In some examples, the foam is EVA, PU, Silicone, and/or other types or combinations of foams.

In some examples, the foam can have a hardness of about 20C. In some examples, the foam can be softer, and have a hardness in a range of 10-20C.

In some examples, the top cloth (or textile) comprises a synthetic textile, such as polyester or nylon.

As shown in FIGS. 3A and 3B, as the force 132 (e.g., the wearer's bodyweight) is applied to a portion of the insole 100, a dome 144 can be compressed and depressed into a respective dome 112, thereby depressing the respective dome 112 toward the second layer 104. During deflection to the second state and return to the first state, the dome 144 can follow the contour of and be disposed against the respective dome 112.

In some examples, the third layer 106 can have a thickness in a range of 1-4 mm, or 2.5-3.5 mm.

In some examples, if the third layer 106 comprises only a textile (instead of foam), the third layer 106 can have a thickness of 0.5-1.5 mm.

The insole 100 can include a fourth layer 108. The fourth layer 108 can be disposed against the outward-facing side 152 (or surface) of the second layer 104. For example, an inward-facing side 156 (or surface) of the fourth layer 108 can be disposed against (in face-to-face contact with) the outward-facing side 152 of the second layer 104 when the insole 100 is assembled (as shown in FIGS. 1-3B).

When a dome 112 of the first layer 102 is in the second state (deflected or depressed state shown in FIG. 3B), at least the peak of the dome 112 extends into the respective aperture 140 of the second layer 104 toward the inward-facing side 156 of the fourth layer 108.

In some examples, in the second state, the dome 112 can contact the inward-facing side 156 of the fourth layer 108. In this way, the fourth layer 108 can serve as a backstop (or backboard) for the domes 112.

In some examples, the fourth layer 108 is relatively flat or planar.

The fourth layer 108 can comprise a polymer. In some examples, the fourth layer 108 comprises PETG.

In some examples, the fourth layer 108 comprises rubber. A rubber fourth layer 108 may provide increased sound dampening as the domes 112 move between their first and second states.

The fourth layer 108 has a thickness that can be in a range of 0.38-1.5 mm (0.015-0.06 inches). In some examples, the fourth layer 108 has a thickness that can be about 0.51 mm (0.02 inches).

In some examples, when the fourth layer 108 comprises rubber, it can have a thickness of about 1.5 mm, or in a range of 1-1.8 mm.

In some examples, the fourth layer 108 is formed by laser cutting.

In some examples, the fourth layer 108 is formed by die cutting.

The insole 100 can include a fifth layer 110. The fifth layer 110 can form an outermost layer of the insole 100 (on the outward-facing side). For example, the fifth layer 110 can be configured to provide grip to a strobel of the upper (e.g., upper 404 shown in FIG. 11, as described below).

In some examples, the fifth layer 110 can be disposed against the outward-facing side 158 of the fourth layer 108. For example, an inward-facing side 160 of the fifth layer 110 can be disposed against (in face-to-face contact with) the outward-facing side 158 of the fourth layer 108.

In some examples, if the fourth layer 108 is omitted from the insole 100, the fifth layer 110 can be disposed against the outward-facing side 152 of the second layer 104.

The fifth layer 110 is a textile. In some examples, the textile is a knit, woven, or non-woven textile. In some examples, the non-woven textile is felt. In this way, the fifth layer 110 can comprise a material that provides grip between the insole 100 and the strobel of the upper of the article of footwear (when the insole 100 is disposed within the upper, such as described below with reference to FIG. 11). For example, an outward-facing side 164 of the fifth layer 110 can be configured to be disposed against and grip the strobel of the upper of an article of footwear.

The fifth layer 110 has a thickness 162. In some examples, the thickness 162 is in a range of 1.5-2.5 mm, 1.8-2.2 mm, 1.95-2.05 mm or about 2 mm.

In some examples, the fifth layer 110 is relatively flat or planar.

Edges of one or more layers of the insole 100 form a periphery, i.e., a peripheral boundary, of the insole 100. In some examples, edges of at least the first layer 102 form the peripheral boundary of the insole 100. In some examples, edges of the first layer 102 and the second layer 104 from the peripheral boundary of the insole 100.

In some examples, one or more of the layers 104, 106, 108, and/or 110 can be omitted from the insole 100. For example, in some examples, the insole 100 may not include the fourth layer 108. In some examples, the insole 100 may not include the third layer 106.

In some examples, the insole 100 (or sockliner) can be formed by forming a rolled good or assembly of all the stacked layers of the insole 100 and then die cutting the assembly into the desired overall shape of the insole 100. As such, different sizes for the insole 100 (or sockliner) can be formed from a same stacked roll of assembled layers.

In some examples, the insole 100 (or the insole 200, as described below), can include an additional layer that is configured to attenuate (or dampen) sound as the domes 112 deflect from their first state to their second state and/or as they return (or rebound) to their first state, such as the exemplary sixth layer 170 depicted in FIGS. 12 and 13.

Figure 13:
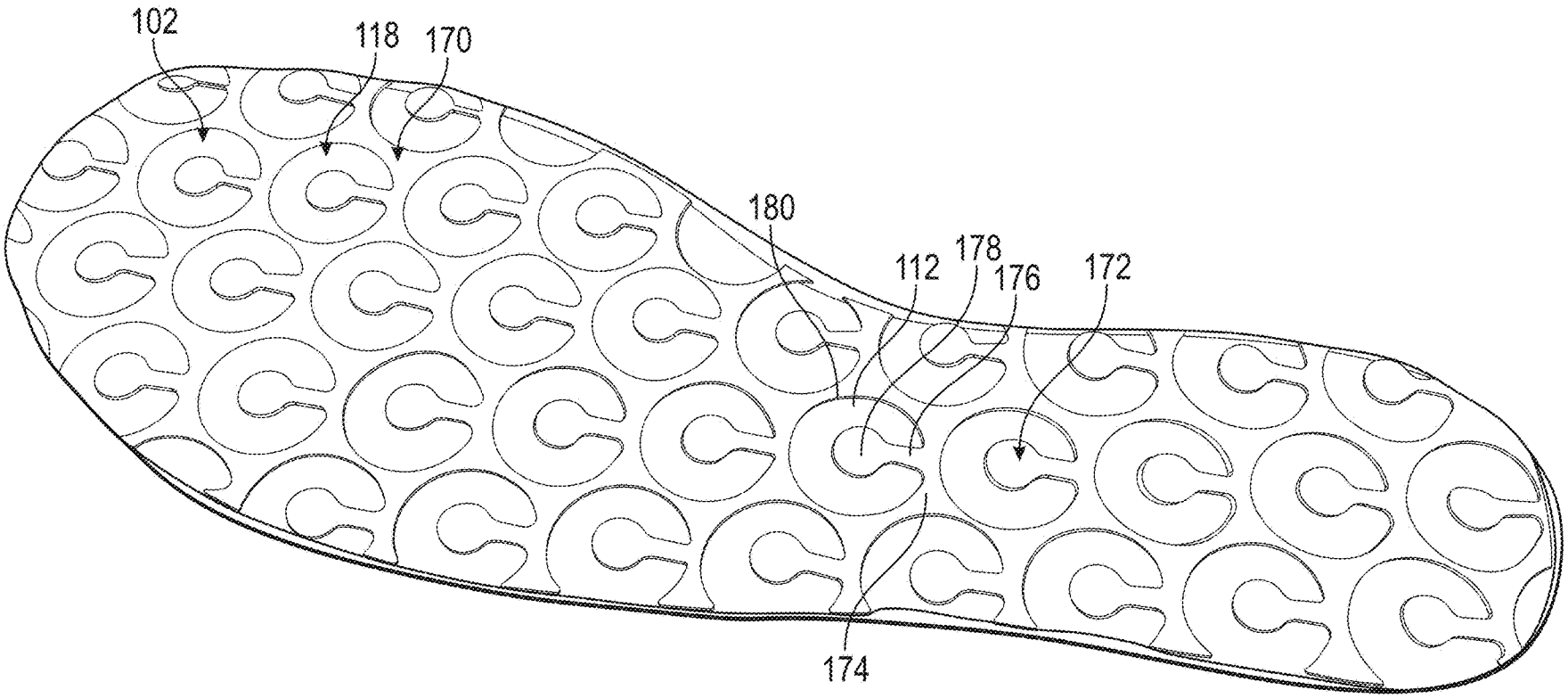
FIG. 13 is a bottom view of the layer of FIG. 12 attached to another layer for the insole that comprises a plurality of deflectable domes.

As shown in FIG. 13, the sixth layer 170 is configured to be coupled to the first layer 102. Thus, in some examples, the sixth layer 170 can be disposed between the first layer 102 and the second layer 104 in the insole 100 (or similar insole, such as insole 200). In such instances, in FIG. 4, the sixth layer 170 would be arranged between the first layer 102 and the second layer 104.

Figure 12:
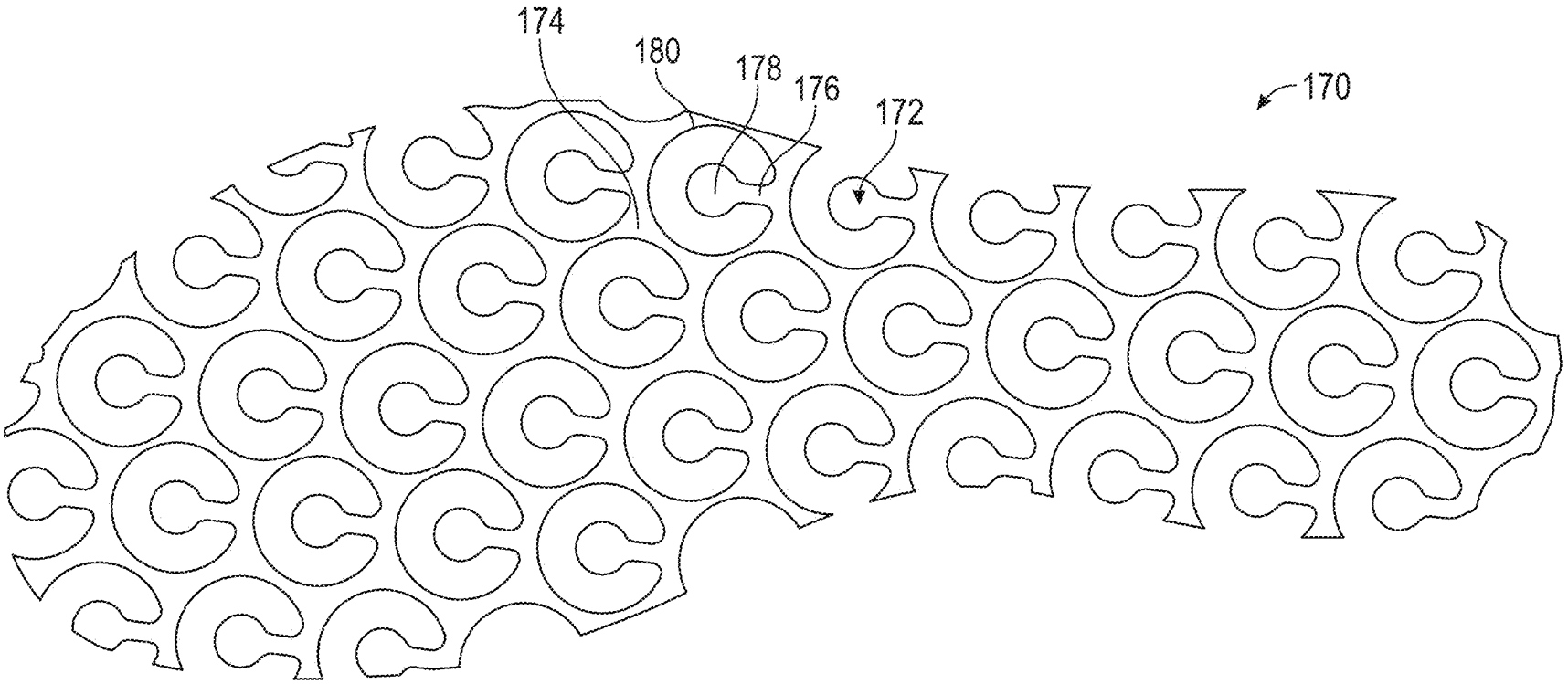
FIG. 12 is a top view of a layer for an insole, such as the insole of FIG. 1, where the layer is configured to attenuate sound.

As shown in FIG. 12, the sixth layer 170 can comprise a sheet of material that is cut to form a plurality of projections 172 that extend from a connecting portion 174 of the sheet. Each projection 172 comprises a stem 176 and a free end 178 disposed at a distal end of the stem 176. The free end 178 can be wider than the stem 176, as shown in FIGS. 12 and 13.

In some examples, the free end 178 of the projection 172 is circular.

Each projection 172 is surrounded (and formed) by a cut-out 180. In some examples, as shown in FIGS. 12 and 13, each cut-out 180 is C-shaped, thereby defining the stem 176 and rounded free end 178 of the corresponding projection 172.

When the sixth layer 170 is disposed between the first layer 102 and the second layer 104 in the insole (such as insole 100), the connecting portion 174 of the sixth layer 170 can be sandwiched between and contact each of the first layer 102 and the second layer 104.

The sixth layer 170 can comprise a flexible material that is configured to dampen or attenuate sound. In some examples, the sixth layer 170 comprises synthetic leather. In some examples, the sixth layer 170 comprises rubber.

Each cut-out 180 can be shaped and sized to encircle a respective dome 112 in the first layer 102. As a result, the free end 178 of the projection 172 formed by the cut-out 180 can be disposed over and attached to the apex or peak 136 of the respective dome 112, as shown in FIG. 13.

The sixth layer 170 is attached (e.g., bonded by adhesive or other attachment methods) to the outward-facing side 118 of the first layer 102, as shown in FIG. 13. In some examples, as shown in FIG. 13, each free end 178 of a projection 172 is attached to the center (or peak 136) of a respective dome 112. As noted above, in examples where the insole 100 includes the sixth layer 170, the sixth layer 170 can be attached to the outward-facing side 118 of the first layer 102 and arranged adjacent to the inward-facing side 154 of the second layer 104 (see FIGS. 3A and 4 for references to the sides of the layers).

By attaching the free ends 178 of the projections 172 to the domes 112, mass is added to each dome 112, thereby helping to dampen some of the resonance of the dome as it deforms (between the first and second states, as described herein). As a result, any popping noises that the domes 112 may make as a user puts their weight onto and off the insole may be reduced, thereby providing the user (wearer) with a more favorable experience while wearing the article of footwear including the insole.

Figure 5:
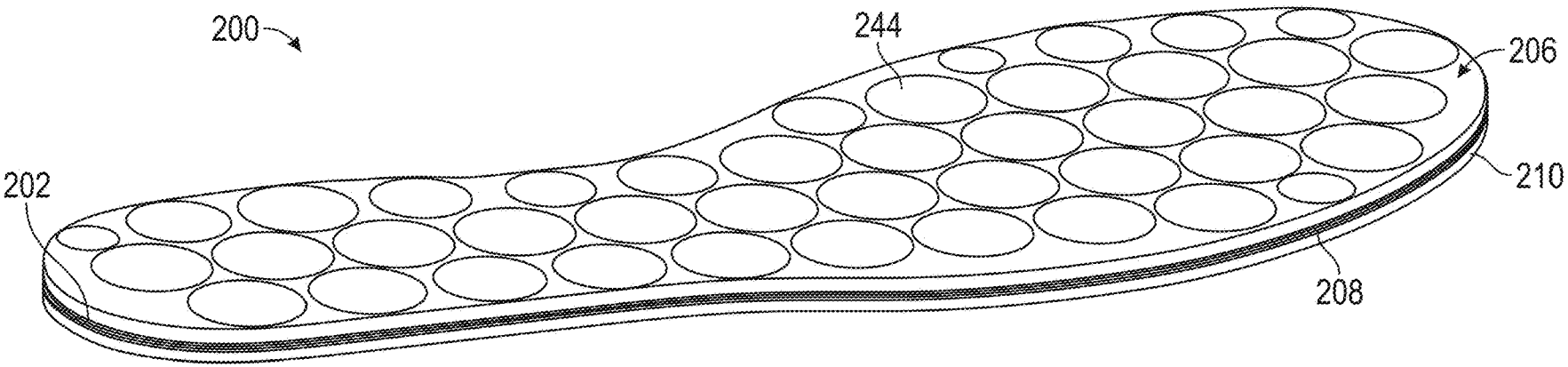
FIG. 5 is a perspective view of an exemplary insole for an article of footwear, with an alternative arrangement of domes across the insole.

FIG. 5 shows an exemplary insole 200 that is similar to the insole 100, except it has a different arrangement of domes 244 of the third layer 206 and domes of the first layer 202 (which can otherwise be the same or similar to the first layer 102 of insole 100). It should be noted that although the domes of the first layer 202 are not visible in the view of FIG. 5, each dome of the first layer 202 can be disposed directly underneath a respective dome 244 of the third layer 206. Additionally, each layer or component of the insole 200 that corresponds to a layer or component of the insole 100 can be numbered similarly. For example, layer 206 can correspond to layer 106 and layer 202 can correspond to layer 102.

In the insole 200, the domes 244 of the third layer 206 (and domes of the first layer 202) can be sized and arranged across the insole 200 such that there are no partial domes (for example, half or quarter domes). As a result, the domes 244 (and corresponding domes of the first layer 202) can have varying diameters such that all the domes fit within the boundaries of the insole 200. For example, as shown in FIG. 5, some of the domes 244 that are located near the periphery of the insole 200 can have a smaller diameter than the domes 244 disposed closer to a central longitudinal axis of the insole 200.

A second layer of the insole 200 (which can be similar to the second layer 104 of the insole 100) can have correspondingly sized apertures (for example, a diameter of the apertures can match the diameter of the domes 244 and underlying domes of the first layer 202).

Remaining layers of the insole 200 can be the same of similar to the insole 100. For example, the insole 200 can include a fourth layer 208 and fifth layer 210 (which are the same or similar to the fourth layer 108 and fifth layer 110 of the insole 100).

Figure 6:
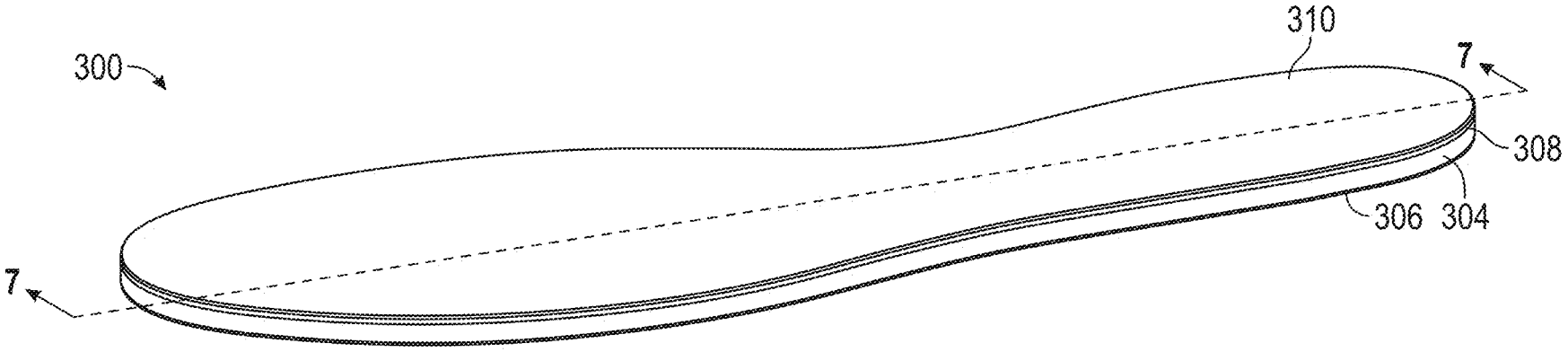
FIG. 6 is a perspective view of an exemplary insole for an article of footwear, where the insole comprises at least one snap dome that is configured to provide tactile feedback to a wearer.
Figure 7:
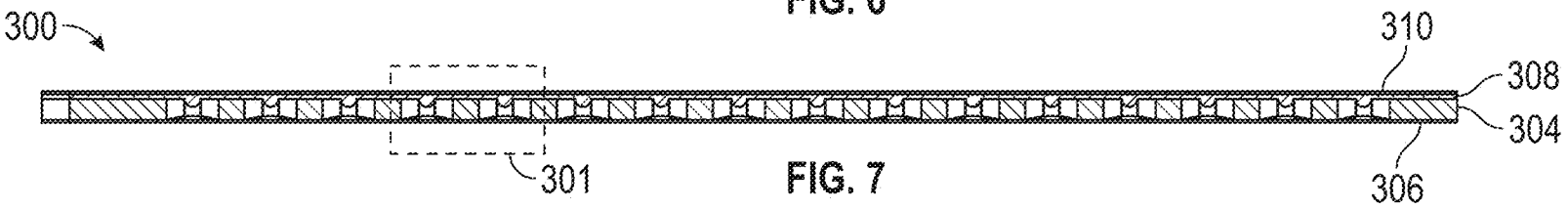
FIG. 7 is a cross-sectional side view of the insole of FIG. 6.
Figure 8:
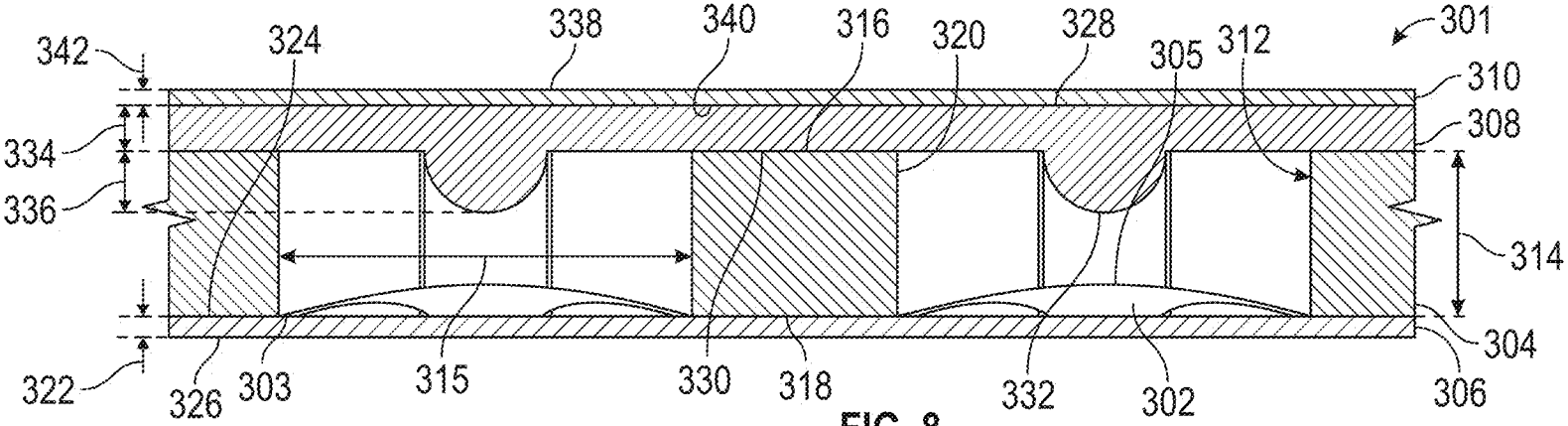
FIG. 8 is a detail view of a portion of the cross-sectional view of FIG. 7.
Figure 9:
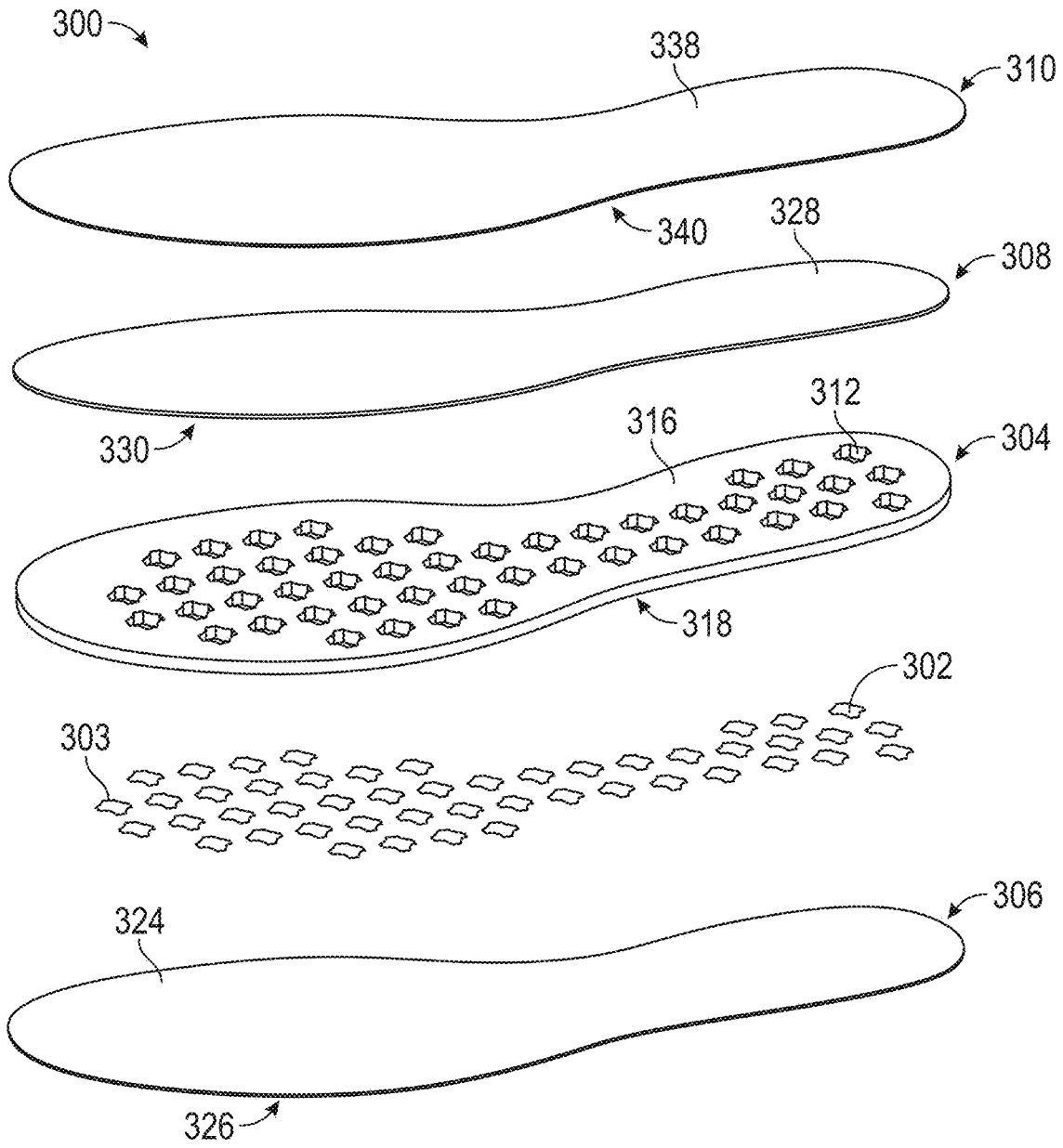
FIG. 9 is an exploded view of the insole of FIG. 6.
Figure 10:
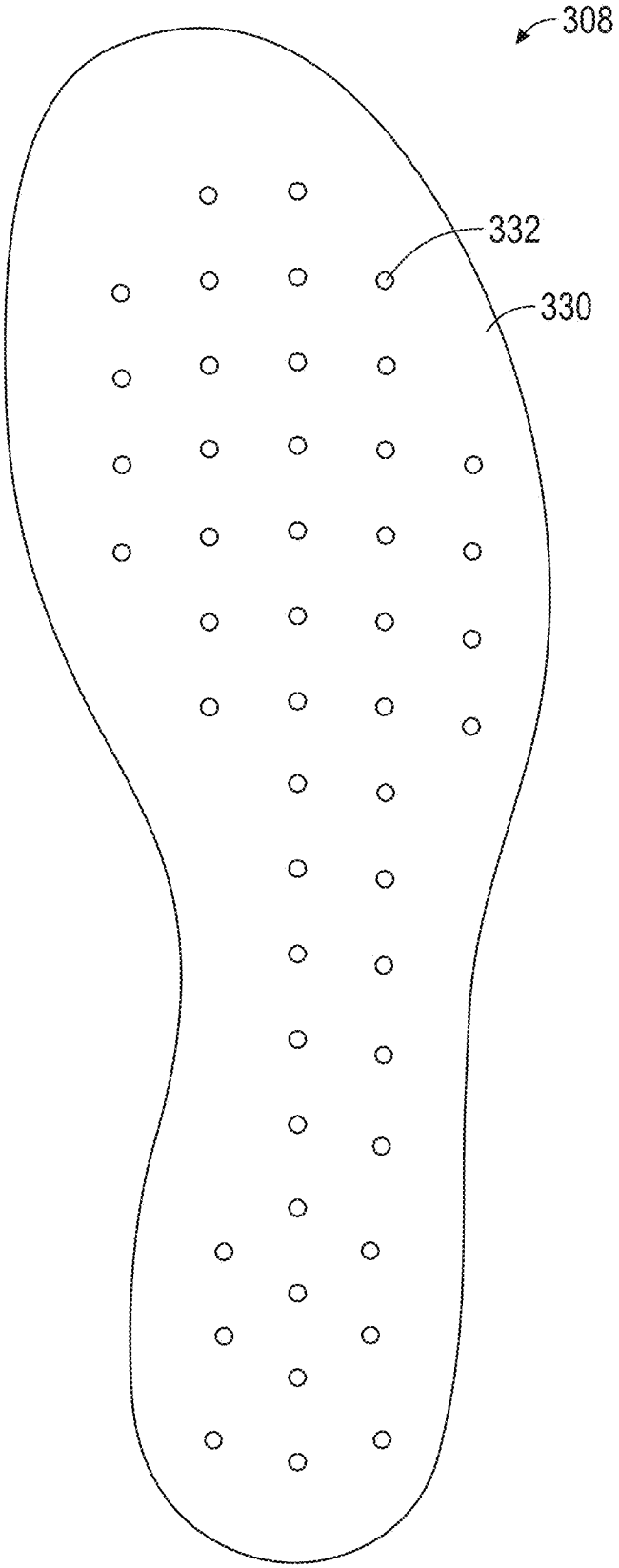
FIG. 10 shows an outward-facing surface of a third layer of the insole of FIG. 6 which includes a plurality of spaced apart projections configured to interact with the snap domes.

FIGS. 6-10 show an exemplary insole 300 for an article of footwear (such as the article of footwear 400 shown in FIG. 11, as described further below) that includes components that provide tactile sensation to a wearer's foot (the sole of the foot). The insole 300 can include one or more layers. In some examples, as shown in FIGS. 6-9, the insole 300 includes a plurality of stacked layers. FIG. 6 shows a perspective view of the assembled insole 300, FIG. 7 shows a cross-sectional side view of the assembled insole 300, FIG. 8 shows a detail view of a portion 301 of the cross-sectional view of FIG. 7, and FIG. 9 shows an exploded view of the insole 300. FIG. 10 shows an outward-facing surface 330 (or side) of the third layer 308 of the insole 300.

The insole 300 includes one or more snap domes 302 (referred to herein as "domes") that are configured to deflect in response to an applied force (e.g., bodyweight of the wearer) and return to their undeformed state when unloaded (when the force is removed). The dome(s) 302 can be referred to as being "monostable" since they have a stable or resting, first state (which can be referred to as an undeformed state) and move into a second state (which can be referred to as a deformed state) in response to an input (applied force).

In some examples, the insole 300 can include a single dome 302.

In some examples, as shown in FIGS. 7-10, the insole 300 comprises a plurality of domes 302.

The domes 302 are individual domes 302 that are not connected to one another, as shown in the exploded view of FIG. 9.

In some examples, the domes 302 comprise metal, such as a spring steel.

In some examples, the domes 302 comprise a polymer.

In some examples, the domes 302 comprise a composite (e.g., carbon fiber).

The domes 302 are not fixed to other components of the insole 300. For example, each dome 302 is not fixed around its edges.

Instead, each dome 302 is disposed within a cell 312 (or aperture) of a first layer 304 of the insole 300. In some examples, the first layer 304 comprises at least one cell 312 configured to receive the at least one dome 302.

In some examples, such as shown in FIGS. 6-10, the first layer 304 can comprise a plurality of cells 312 spaced apart across the first layer 304 (which can also be referred to as an array of cells 312). The cells 312 can extend through an entire thickness 314 of the first layer 304. As such, each cell 312 can be open on both ends.

In some examples, the cells 312 may not extend through the entire thickness 314. Instead, the cells 312 can extend through a portion of the thickness 314 of the first layer 304, such as from an inward-facing surface 316 toward (but not all the way to) an outward-facing surface 318 of the first layer 304. As such, the cells 312 can be open at one end (at the inward-facing surface 316) and closed at another end (closed by the outward-facing surface 318 covering the cell 312).

In some examples, the thickness 314 of the first layer 304 can be in a range of 3-5 mm, 3.5-4.5 mm, or 3.9-4.1 mm. In some examples, the thickness 314 of the first layer 304 can be about 4 mm (e.g., 4±0.05 mm).

In some examples, a shape of the cells 312 can match a shape of the domes 302. For example, as shown in FIG. 9, in some instances, each dome 302 can have four points or end edges 303 that extend outward from a central portion of the dome 302. The central portion of the dome 302 is raised or protrudes outward relative to the end edges 303, thereby creating its dome shape. The sidewalls 320 of each cell 312 can match the overall shape (e.g., width) of the corresponding dome 302 so that the dome 302 fits within the cell 312.

In some examples, each cell 312 can have a width 315 that is the same as the width of the dome 302 (measured from one end edge 303 to an opposite end edge 303).

In some examples, each cell 312 can have a width 315 that is larger than the width of the dome 302.

Each dome 302 sits freely within a respective cell 312, such that the dome 302 is unattached to the sidewalls 320 of the cell 312. For example, all the end edges 303 of the dome 302 can be unattached to the sidewalls 320 of the cell 312.

In some examples, all the end edges 303 of the dome 302 are spaced apart from the sidewalls 320 of the cell 312.

In some examples, the first layer 304 can comprise foam. In some examples, the foam is Ortholite. In this way, the first layer 304 can be compressible.

The insole 300 can include a second layer 306 that serves as a backboard or base layer to the first layer 304.

In some instances, when the cells 312 do not extend all the way through the first layer 304 (such that they are not open at the outward-facing surface 318), the insole 300 may not include the second layer 306.

The second layer 306 can comprise a polymer. In some examples, the polymer is polyethylene terephthalate glycol (PETG).

The second layer 306 has a thickness 322 defined between an inward-facing surface 324 and an outward-facing surface 326 of the second layer 306.

In some examples, the thickness 322 can be in a range of 0.25-1.0 mm, 0.25-0.51 mm, or 0.4-0.5 mm.

The inward-facing surface 324 of the second layer 306 can be disposed against (e.g., in face-to-face contact with) the outward-facing surface 318 of the first layer 304. As such, the end edges 303 of each dome 302 can rest against the inward-facing surface 324 of the second layer 306.

The insole 300 can include a third layer 308 that is configured to activate or interact with the domes 302. For example, the third layer 308 has an inward-facing surface 328 and an outward-facing surface 330. The outward-facing surface 330 includes at least one projection 332 that is configured to press into and against an apex 305 of the central portion of a corresponding dome 302, as a force is applied to the inward-facing surface 328 of the third layer 308.

In some examples, as shown in FIG. 10, the third layer 308 includes a plurality of projections 332 that are spaced apart across the outward-facing surface 330 of the third layer. Each projection 332 can be configured to press against a respective dome 302 within a respective cell 312 of the first layer 304. For example, when the outward-facing surface 330 of the third layer is disposed again the inward-facing surface 316 of the first layer 304, each projection 332 extends at least partially into the respective cell 312, toward but spaced away from the respective dome 302 (as shown in FIG. 8).

The third layer 308 has a thickness 334 defined between inward-facing surface 328 and the outward-facing surface 330. Each projection 332 has a height 336 (as shown in FIG. 8). In some examples, the height 336 can be in a range of 0.75-2.0, 0.8-1.5, or 1-1.4 mm. This height 336 can vary based on the stiffness and thickness of the third layer 308, and/or the dome height.

In some examples, the third layer 308 comprises a polymer, such as thermoplastic polyurethane (TPU). In some examples, the third layer 308 comprises 3D printed TPU.

The insole 300 can include a fourth layer 310. The fourth layer 310 has an inward-facing surface 338 and outward-facing surface 340, where the outward-facing surface 340 is disposed against (in face-to-face contact with) the inward-facing surface 328 of the third layer 308.

The fourth layer 310 can, in some examples, comprise a textile (e.g., a top cloth) and form a top covering for the insole 300. The fourth layer 310 has a thickness 342 that can be in a range of 0.2-1.0 mm.

In some examples, one or more of the layers 306 and/or 310 can be omitted from the insole 300.

During use within an article of footwear (such as the article of footwear 400 shown in FIG. 11), when a compressive force (e.g., from the wearer's foot) causes the first layer 304 to compress, each projection 332 of the third layer 308 moves toward and contacts a corresponding dome 302 and elastically deforms it within the corresponding cell 312. In some examples, this can include pressing the apex 305 (or peak) of the dome 302 toward the inward-facing surface 324 of the second layer 306. In this manner, the projection 332 provides a point load against the surface of the central portion of the dome 302.

When the dome 302 is unloaded (e.g., when the wearer's bodyweight is lightened or removed), the dome 302 quickly snaps back to its original shape (the first state shown in FIG. 8). The snap back of the dome 302 can create a pop, or perceptible sensation on the wearer's foot. The various domes 302 of the insole 300 "pop" as the wearer shifts their weight around, thereby providing tactile feedback to the wearer.

Figure 11:
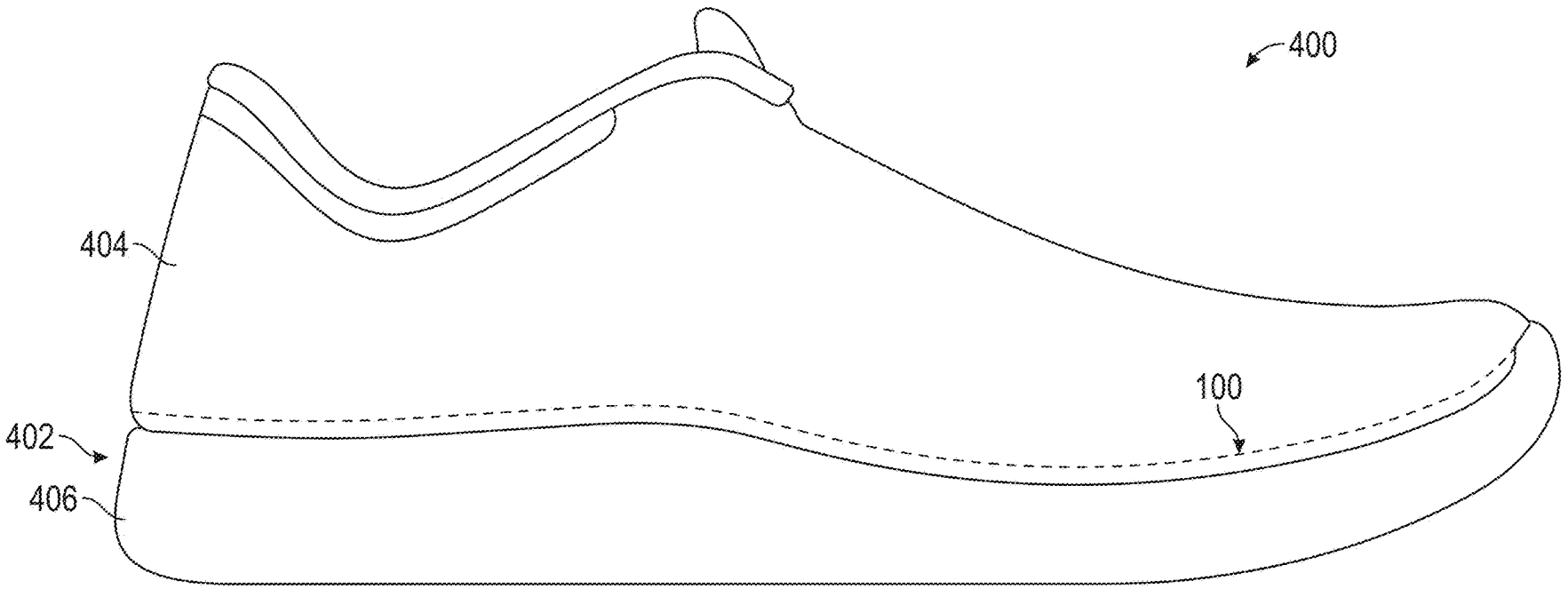
FIG. 11 is an exemplary article of footwear that includes an insole comprising at least one deflectable dome that provides tactile feedback to a wearer of the article.

FIG. 11 shows an exemplary article of footwear 400 that is configured to include the insole 100 (or any of the other insoles described herein, such as the insole 200, the insole 300, or the insole 500). Specifically, FIG. 11 shows a side view of the article of footwear 400, which can also be referred to simply as the article 400.

The article 400 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some examples the article 400 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

The article of footwear 400 comprises two main components: a sole structure 402 and an upper 404. The upper 404 is coupled to the sole structure 402 so as to form a foot-receiving cavity between the sole structure 402 and the upper 404. For example, the upper 404 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. The upper 404 can have a variety of shapes, sizes, and/or designs. For example, in examples where the article of footwear 400 is a running shoe, the upper 404 could be a low top upper. In examples where the article of footwear 400 is a basketball shoe, the upper 404 could be a high-top upper that is shaped to provide support on an ankle.

The sole structure 402 can be configured to provide traction for the article of footwear 400. In addition to providing traction, the sole structure 402 may attenuate ground reaction forces when compressed between the foot and the ground during walking, running, or other ambulatory activities. The configuration of the sole structure 402 can vary in different examples to include a variety of conventional or non-conventional structures. The sole structure 402 extends between the upper 404 and the ground when the article of footwear 400 is worn. In different examples, the sole structure 402 can include different components. For example, the sole structure 402 can include an outsole, a midsole, and/or an insole. In some cases, one or more of these components may be optional.

In the example shown in FIG. 11, the sole structure 402 comprises an outsole 406. In some examples, the outsole 406 is coupled directly to the upper 404. In some examples, a midsole can be disposed between the upper 404 and the outsole 406 (e.g., where the midsole is configured to provide cushion).

In some instances, the outsole 406 of the sole structure 402 can be configured according to one or more types of ground surfaces on which outsole 406 can be used. For example, a shape, size, and/or number of lugs or protruding members of the outsole can be specified based on the type of ground surface on which the outsole can be used. As another example, a material and/or material properties (e.g., density, surface finish, or the like) of the outsole can be specified based on the type of ground surface on which the outsole can be used. Examples of ground surfaces include, but are not limited to: natural turf, synthetic turf, dirt, natural grass, soft natural grass, as well as other surfaces.

The sole structure 402 further includes the insole 100. However, in some examples, the insole 100 can be replaced by any of the other insoles described herein, within the article 400.

The insole 100 is arranged inside the upper 404. In some examples, the upper 404 includes a strobel and the insole 100 is arranged inside the upper 404, against the strobel. In this way, in some examples, an upper or inward-facing surface of the insole 100 can be in direct contact with a wearer's foot, when the article 400 is worn by a wearer.

Figure 14:
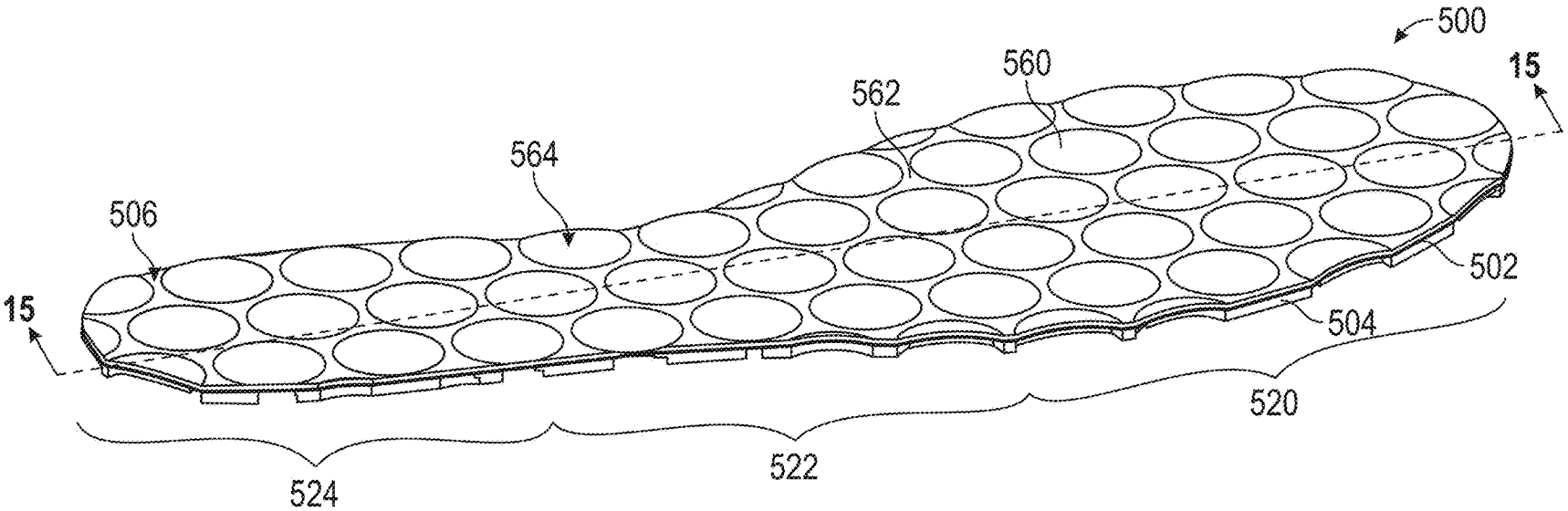
FIG. 14 is a perspective view of an exemplary insole for an article of footwear, where the insole comprises a first layer comprising at least one dome that is configured to provide tactile feedback to a wearer and a second layer that is configured to receive the at least dome therein and attenuate sound.
Figure 15:
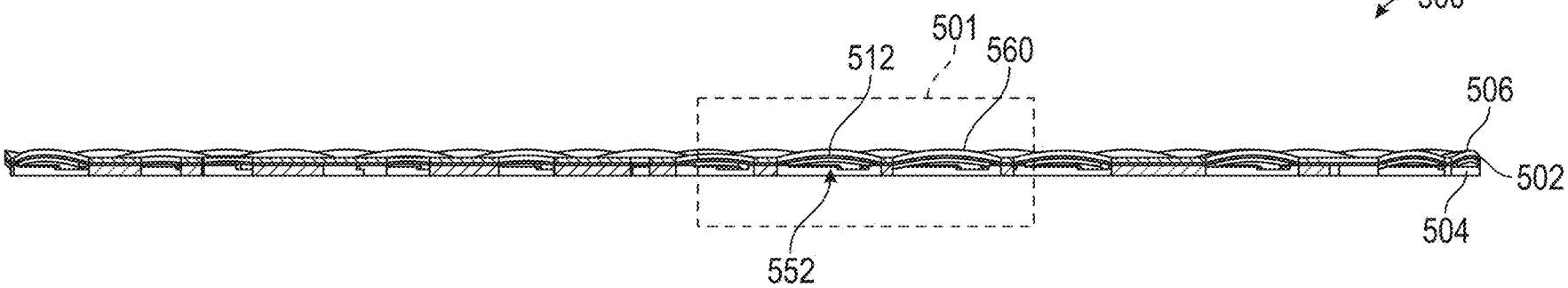
FIG. 15 is a cross-sectional side view of the insole of FIG. 14.
Figure 16A:
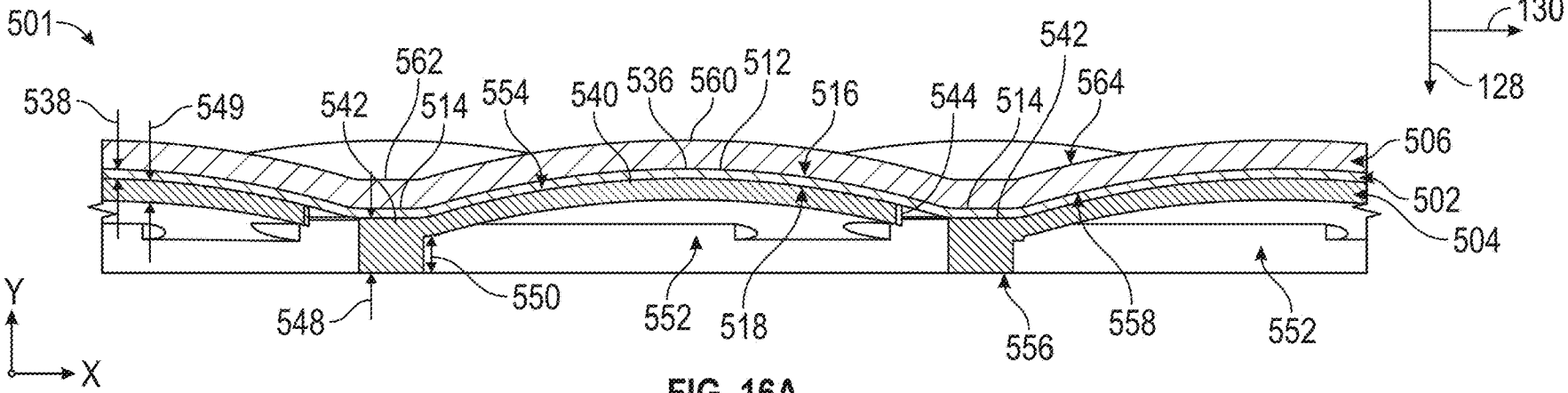
FIG. 16A is a detail view of a selected portion of the cross-sectional view of FIG. 15 with the deflectable domes of the insole in a first state.
Figure 16B:
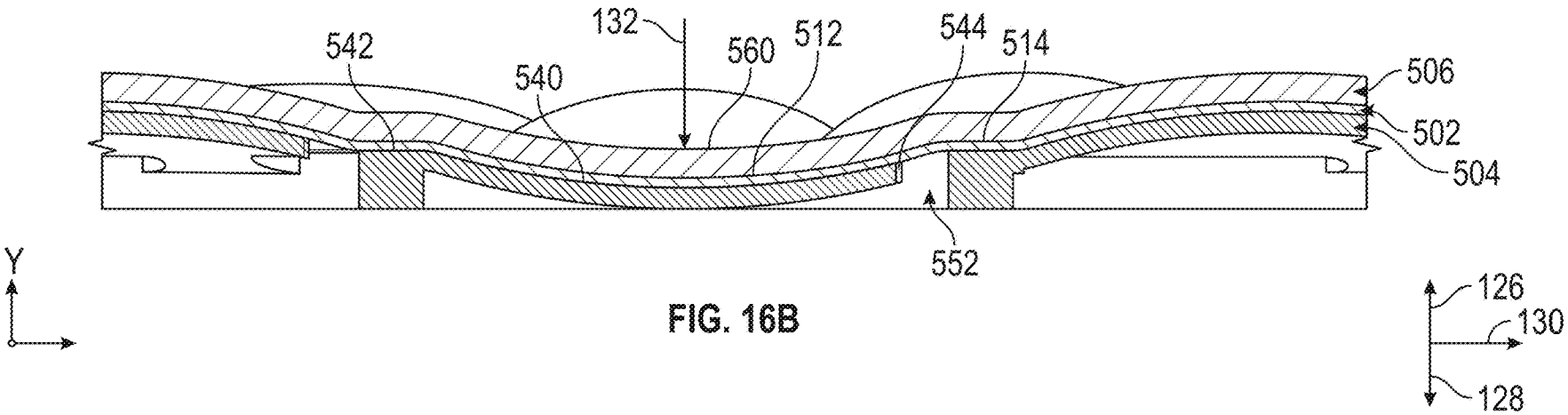
FIG. 16B is a detail view of the selected portion of the cross-sectional view of FIG. 15 with the deflectable domes of the insole in a second state.
Figure 17:
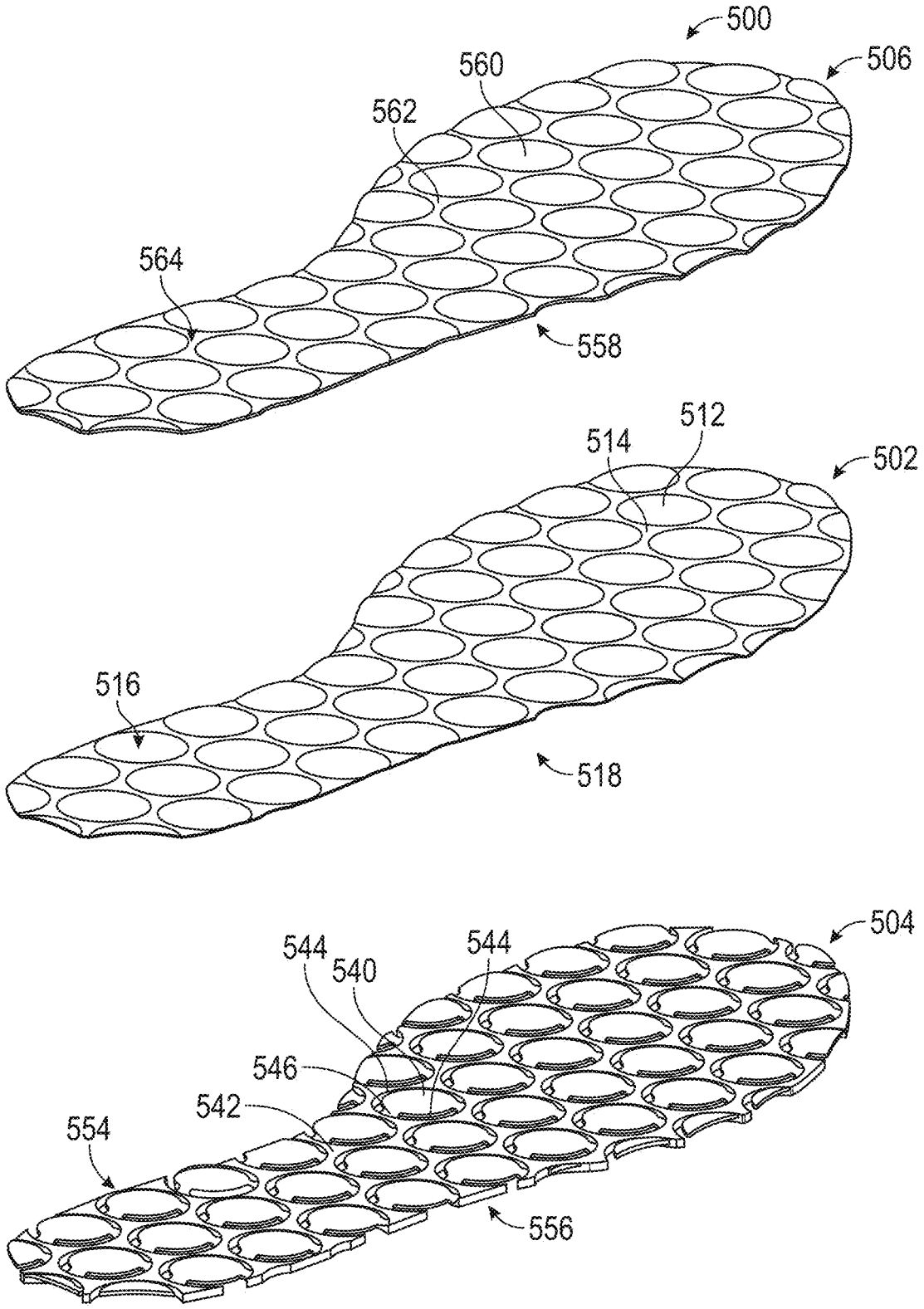
FIG. 17 is an exploded view of the insole of FIG. 14.

FIGS. 14-18 show an insole 500 for an article of footwear (such as the article of footwear 400 shown in FIG. 11, as described herein). The insole 500 can include one or more layers. In some examples, as shown in FIGS. 14-17, the insole 500 includes a plurality of stacked layers. FIG. 14 shows a perspective view of the assembled insole 500, FIG. 15 shows a cross-sectional side view of the assembled insole 500, and FIG. 17 shows an exploded view of the insole 500. FIG. 16A shows a detail view of a selected portion 501 of the cross-sectional side view of FIG. 15.

The insole 500 can be similar to the insole 100, as described herein. For example, the insole 500 comprises a first layer 502 that can be the same or similar to the first layer 102 of the insole 100. However, a second layer 504 of the insole 500 can be configured to both receive the domes of the first layer 502 therein (when in the deflected, second state) and provide sound attenuation or dampening.

As shown in FIGS. 14-17, the first layer 502 comprises a plurality of domes 512 spaced apart from one another across the first layer 502 (as shown in FIG. 17). The first layer 502 further comprises a connecting portion 514 that extends between and around the plurality of domes 512. The connecting portion 514 can be continuous. In some examples, the connecting portion 514 can be referred to as being formed by a plurality of connecting segments that are continuous across the first layer 502.

In this way, each dome 512 can be surrounded (e.g., completely surrounded around its perimeter) by the connecting portion 514 (unless it is a dome 512 formed at the edge of the first layer 502, in which case it's interior side or edges are surrounded by the connecting portion 514).

The first layer 502 can also be referred to as a sheet comprising the plurality of domes 512 and the connecting portion 514. For example, the first layer 502 (or sheet) can comprise a continuous piece of material with the plurality of domes 512 formed therein. In this way, in some examples, the first layer 502 can be referred to as an integral component that is formed as one piece (e.g., molded as one unitary piece).

In some examples, a spacing between adjacent domes 512 can vary. In some examples, the spacing between adjacent domes 512 can be within a range of 0.5-3 mm (or 10-30 mm measured from a center of one dome to a center of an adjacent dome). In some examples, the spacing between adjacent domes 512 can be about 2 mm (or 22 mm measured from a center of one dome to a center of an adjacent dome).

In some examples, the spacing between adjacent domes 512 can be larger or smaller based on the material of the first layer 502 and/or based on desired density of domes across all or a portion of the first layer 502 that is dependent on a desired amount of position awareness or tactile feedback for the wearer. For example, by increasing the spacing between domes, in some instances, the wearer will experience increased sensation (for example, at targeted areas), or notice the sensation more at targeted locations of their foot.

In some examples, the plurality of domes 512 can extend across (or cover) an entire length and width of the insole 500.

In some examples, the plurality of domes 512 can extend across (or cover) at least a portion of the length and width of the insole 500. For example, in some instances, the domes 512 can be arranged in only a forefoot region 520, only midfoot region 522, only a heel region 524, or some combination thereof, of the insole 500.

In some examples, one or more domes 512 can be specifically arranged along the first layer 502 (e.g., within specified regions of the insole 500) to target specified regions of the wearer's foot. For example, one or more domes 512 can be positioned in the midfoot region 522 to target an arch of the wearer's foot and/or one or more domes 512 can be positioned in the forefoot region 520 to target toes or a ball of the wearer's foot. In this way, targeted placement of the domes 512 within the first layer 502 can achieve varying sensations for the wearer.

Each dome 512 is deflectable between a first state (as shown in FIGS. 14-16A and 17) and a second state (as shown in FIG. 16B). The first state can be referred to as an undeflected state and the second state can be referred to as a deflected state. In the first state, at least a peak of the dome 512 protrudes (or extends) outward or away from the connecting portion 514, in a first direction 126 (as depicted in FIG. 16A). In the second state, at least the peak of the dome 512 protrudes (or extends) outward or away from the connecting portion 514, in a second direction 128 (as depicted in FIG. 16B). The first and second directions 126, 128 can be positive and negative vertical directions, which are perpendicular to a longitudinal direction 130, as depicted by the coordinate axis in FIGS. 16A and 16B.

When the insole 500 is arranged within an article of footwear (such as the article of footwear 400 shown in FIG. 11), the first direction 126 is toward an interior of the article of footwear (e.g., toward the wearer's foot when the article of footwear is worn by an individual) and the second direction 128 is toward a remainder of the sole structure of the article of footwear (such as the outsole).

In some examples, in the second state, at least the peak of the dome 512 is disposed flush with the connecting portion 514.

In some examples, in the second state, at least the peak of the dome 512 extends beyond the connecting portion 514 into an adjacent layer of the insole 500, as described further below.

Each dome 512 is deflectable from the first state to the second state in response to a force 132 (depicted schematically by an arrow in FIG. 16B) applied to the dome 512. The deflected dome 512 snaps back to the first state from the second state in response to removal of the force 132. The rebounding or "snapping back" of the dome 512 from the second state to the first state, upon removal of the force 132 (unloading of the dome 512), can deliver a first tactile sensation (or feedback) to the sole of the wearer's foot.

In some examples, the wearer can experience a second tactile sensation (e.g., a haptic snapping sensation) from depressing the dome 512 (or domes) from the first state into the second state (which depresses the dome 512 into an underlying second layer 504 of the insole 500 and away from the wearer's foot).

In this way, in some examples, the wearer can experience two tactile sensations, one when each dome 512 is depressed (into the second state), and another when each dome rebounds back to the first state after the force 132 is removed.

As already described herein with reference to the insole 100, the force 132 can be a force (e.g., body weight of the wearer) applied to the insole 500 as the wearer is walking, running, or otherwise moving around while wearing the article of footwear including the insole 500. Thus, as the wearer moves around, multiple domes 512 can be depressed at once and to varying degrees. For example, different magnitudes of force can be applied to different domes 512 in the first layer 502 based on how the wearer is moving and/or how they distribute their weight across the insole 500 as they are performing different activities. As a result, the domes 512 can provide feedback to the wearer as to how they are moving, distributing their weight, and the like, as they wear the article of footwear.

Returning to FIGS. 14-17, the first layer 502 can comprise an inward-facing side 516 (facing an interior of the article of footwear, as defined above) and an opposite, outward-facing side 518 (facing toward the outsole of the article of footwear, as defined above). In the first state of each dome 512, the dome 512 is convex relative to the inward-facing side 516 and concave relative to the outward-facing side 518. In the second state of each dome 512, the dome 512 is concave relative to the inward-facing side 516 and convex relative to the outward-facing side 518. In some examples, as used herein, the inward-facing or outward-facing sides of the different layers can also be referred to as first/second or inward/outward-facing surfaces of the layers.

Each dome 512 can have a diameter (or width) in a range of 10-30 mm, 15-25 mm, or 18-22 mm. In some examples, each dome 112 can have a diameter (or width) of about 20 mm.

Each dome 112 can have a height (when in the first state, or convex position) in a range of 0.5-2.0 mm, 1.3-1.7 mm, or 1.4-1.6 mm. In some examples, each dome 112 can have a height (when in the first state, or convex position) of about 1.5 mm. In some examples, the height of the domes 112 can vary based on a thickness of the first layer 102 and/or the diameter of the domes 112.

In some examples, the diameter and/or height of the domes 512 can vary based on the type of article footwear and/or a desired amount of tactile feedback or sensation for the wearer. In this way, the height and diameter of each dome 512 and a spacing between domes 512 (and/or location of the domes 512 along the first layer 502) can vary and be specified based on a target tactile sensation for the wearer.

The same as described above and depicted in FIG. 3A, the height (e.g., height 134 shown in FIG. 3A) of a dome 512 (in the first state) can be measured from the connecting portion 514 (on the inward-facing side of the first layer 502) to a peak 536 (or apex) of the dome 512. Thus, when a dome 512 is depressed from the first state into the second state, it can be depressed by an amount that is at least the height of the dome 512. In some examples, when a dome 512 is depressed from the first state into the second state, it can be depressed by an amount that is greater than the height of the dome 512 due to cavities in the underlying second layer 504, as described further below.

In some examples, if a dome 512 is depressed partially (not into or fully into the respective dome or cavity in the second layer 504), the resulting sensation to the wearer may be muted as compared to when the dome 512 is fully depressed into the respective dome or cavity.

In some examples, the height and/or diameter of the domes 512 can vary across the first layer 502. For example, in some instances, at least one dome 512 can have a different height and/or diameter than another dome 512 in the first layer 502.

In some examples, all the domes 512 of the first layer 502 can have the same height, same diameter, or same height and same diameter.

In some examples, each dome 512 can have a height/diameter ratio (height-to-diameter ratio) within a range of 0.06-0.09, or about 0.075. In some examples, the height/diameter ratio of the domes 512 can vary based on the thickness of the material of the first layer 502.

The first layer 502 (or sheet) can comprise a polymeric material. In some examples, the polymeric material is polycarbonate. In some examples, the polymeric material can have a stiffness or elasticity that is configured such that each dome 512 is deflectable from the first state to the second state in response to a force applied to the dome 512, and each dome 512 snaps back to the first state from the second state in response to removal of the force.

In some examples, the material of the first layer 502 (such as the polymeric material) can be configured to have relatively high thermoformability (or ability to otherwise manufacture), high fatigue strength to increase durability, low creep to improve longevity of the tactile experience over life of the product, high stiffness to increase tactility, high impact strength for shape retention, and/or the like. The material can additionally or alternatively be configured for various environmental considerations, such as moisture, bonding, and temperature.

A thickness 538 (depicted in FIG. 16A) of the first layer 502 (or sheet) can be configured such that each dome 512 is deflectable from the first state to the second state in response to a force (e.g., the wearer's bodyweight) applied to the dome 512, and each dome 512 snaps back to the first state from the second state in response to removal of the force. In some examples, the thickness 538 of the first layer 502 can be in a range of 0.26-0.51 mm (0.01-0.02 inches) or 0.35-0.41 mm (0.014-0.016 inches). In some examples, the thickness 538 of the first layer 502 can be about 0.38 mm (0.015 inches).

In some examples, the first layer 502 is formed by vacuum forming the polymeric material.

In some examples, the first layer 502 can be relatively planar.

In some examples, the first layer 502 can be non-planar and have a contour that at least partially follows a shape of a wearer's foot. For example, an arch region of the first layer 502 can protrude outward in the first direction 126 relative to an adjacent portion of the first layer 502 such that it follows a shape of a wearer's foot arch. In this way, the peak 536 of the one or more domes 512 of the first layer 502 can be at different vertical heights relative to one another when in the first state. In some examples, one or more of the additional layers of the insole 500 (such as the second layer 504 and/or the third layer 506) can follow a same contour of the first layer 502. The other insoles described herein, such as the insole 100, can also have one or more layers that are contoured in this way, in some instances.

The insole 500 can include a second layer 504. As shown in FIGS. 14-17, the second layer 504 is disposed adjacent to the first layer 502 within the insole 500. The second layer 504 is disposed against the outward-facing side 518 of the first layer 502. For example, an inward-facing side 554 (or surface) of the second layer 504 can be disposed against (in face-to-face contact with) the outward-facing side 518 of the first layer 502 (as shown in FIGS. 14-16B).

Figure 18:
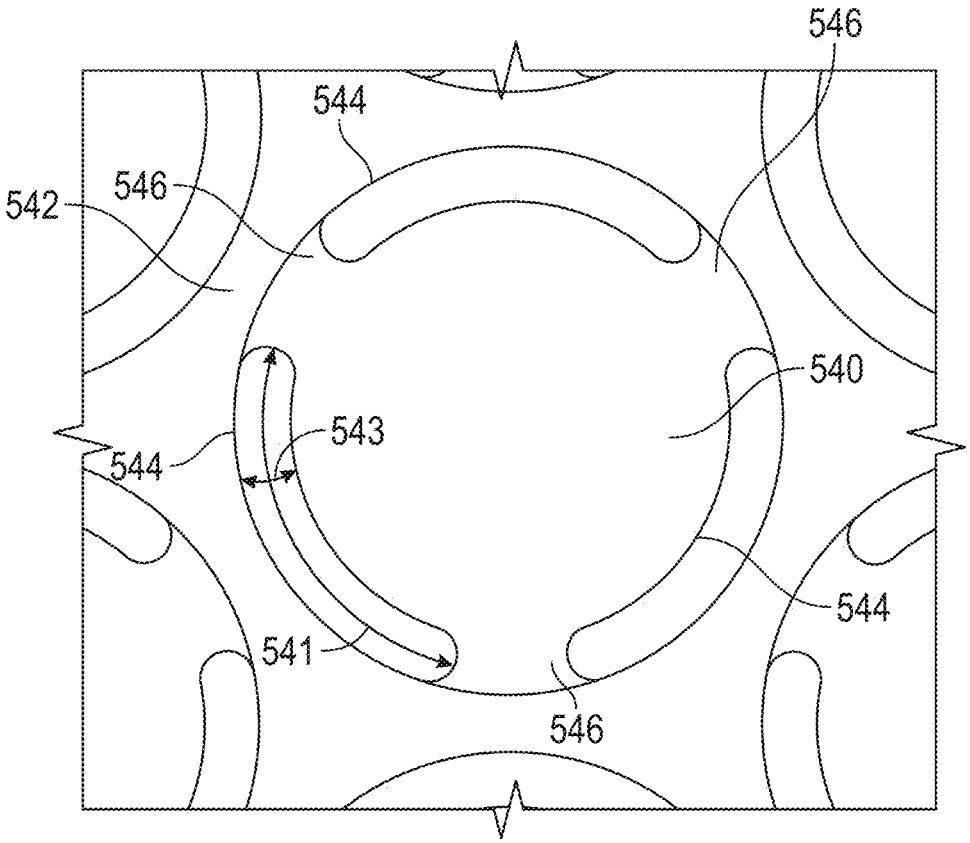
FIG. 18 is a detail view of a portion of the second layer of the insole of FIG. 14.

The second layer 504 comprises a plurality of domes 540 spaced apart from one another (as shown in FIGS. 17 and 18) and a connecting portion 542 that extends between and around the plurality of domes 540. The connecting portion 542 can be continuous. In some examples, the connecting portion 542 can be referred to as being formed by a plurality of connecting segments that are continuous across the second layer 504.

The second layer 504 further comprises a plurality of apertures 544 extending through a thickness of the second layer (and thus can be referred to as through-apertures). For example, the second layer 504 can be a sheet of material with the spaced apart apertures 544 extending through a thickness of the second layer 504.

The apertures 544 are spaced apart from one another around each dome 540. For example, as shown in FIGS. 17 and 18, each dome 540 is surrounded by three apertures 544 spaced apart around a perimeter of the dome 540, thereby forming three arms, bridges, or connectors 546. The connectors 546 connect the dome 540 to the connecting portion 542.

As described further below, each group of apertures 544 spaced apart around the same dome 540 can at least partially define a respective cavity 552 formed underneath the dome 540 in the first state. In some examples, the cavities 552 can be referred to apertures since they extend from the inward-facing side 554, at the respective apertures 544, to an outward-facing side 556 of the second layer 504.

In some examples, each dome 540 can have more or less than three apertures 544 and three connectors 546 around its perimeter. For example, in some instances, each dome 540 can be surrounded by only two apertures 544 and two connectors 546. In some instances, each dome 540 can be surround by three or more apertures 544 and three or more connectors 546.

Each aperture 544 has a length 541 and width 543. In some examples, a size of the apertures 544, including the length 541 and/or width 543, can vary. For example, the apertures 544 can be shorter or longer (thereby decreasing width of the connectors 546) or narrower or wider than shown in FIGS. 17 and 18.

Each dome 540 of the second layer 504 is aligned with a corresponding dome 512 of the first layer 502. For example, as shown in FIGS. 16A and 16B, when the first layer 502 and the second layer 504 are arranged against one another in the insole 500, each dome 540 is disposed directly below a respective dome 512 (such that they are aligned in the longitudinal direction 130 and a lateral direction that is perpendicular to the longitudinal direction 130 and the vertical direction 126, 128).

In some examples, as shown in FIGS. 16A and 16B, the connecting portion 542 of the second layer 504 is aligned with and overlaps the connecting portion 514 of the first layer 502.

Similar to the domes 512, each dome 540 has a corresponding first state (undeflected state), as shown in FIG. 16A, and a second state (deflected state), as shown in FIG. 16B. Each dome 540 is deflectable from the first state to the second state under the applied force 132, as described herein with reference to the domes 512.

A contour of each dome 540 can follow the contour of a respective dome 512. For example, each dome 540 can have an approximately same height and diameter as the respective dome 512 with which it is aligned. By matching, or approximately matching, the contour/shape of the domes 512, the domes 540 may enable smoother and less restricted movement of the domes 512 between the first and second states (as compared to domes 540 that are flat and do not match the contour of the domes 512).

However, in some examples, the domes 540 may not match the contour of the domes 512 and instead may have a smaller height and/or be flat as compared to the height of the domes 512.

The connecting portion 542 has thickness 548. In some examples, the thickness 548 can be in a range of 0.76-2.03 mm (0.03-0.08 inches). In some examples, the connecting portion 542 has a thickness 548 that can be about 1.91 mm (0.075 inches). The thickness 548 of the connecting portion 542 can define a depth 550 of a space or cavity 552 which is configured to receive a respective dome 540 and dome 512 therein. The depth 550 can be measured from the base or bottom of a dome 540 to a base of the connecting portion 542 (and the second layer 504), as depicted in FIG. 16A. As such, as the thickness 548 of the connecting portion 542 increases, a larger perceptible sensation or tactile response to the wearer can be delivered during depression and release of the domes 512 into the cavities 552.

In this way, the second layer 504 can be said to comprise a plurality of cavities 542, each cavity defined by the apertures 544, below a respective dome 540 in the first state.

A thickness 549 of domes 540 can, in some examples, be less than the thickness 548 of the connecting portion 542, as depicted in FIG. 16A.

In some examples, the thickness 549 of the domes 540 in the second layer 504 can be larger than the thickness 538 of the domes 512 in the first layer 502. For example, the thickness 549 can be in a range of 0.51-1.02 mm (0.02-0.04 inches) or 0.71-0.81 mm (0.028-0.032 inches). In some examples, the thickness 549 can be about 0.76 mm (0.03 inches).

In the first state, as shown in FIG. 16A, each respective dome 540 of the second layer 504 and dome 512 of the first layer 502 protrude outward and away from the connecting portion 542 and respective cavity 552 in the second layer 504. Under pressure or force 132, the respective dome 540 and dome 512 extend beyond (below in view of FIG. 16B) the connecting portion 542 and into the respective cavity 552, thereby forming the concave shape relative to the inward-facing side 516 of the first layer 502.

In some examples, the second layer 504 can comprise a thermoplastic elastomer (such as thermoplastic polyurethane, or TPU) or rubber. Such a material may provide increased manufacturability and/or sound dampening as the domes 512 are depressed into and snap back out of the second layer 204.

In some examples, the second layer 504 is formed by injection molding.

In some examples, the second layer 504 can be formed by die cutting.

The second layer 504 has an outward-facing side 556 (or surface). In some examples, the outward-facing side 556 of the second layer can define an outward-facing side or bottom of the insole 500 that is configured to face a strobel and/or outsole of an article of footwear in which it is positioned.

In some examples, the insole 500 can include one or more additional layers, such as a foam layer, on the outward-facing side 556 of the second layer 504 (e.g., similar to the fourth layer 108 and/or fifth layer 110 of the insole 100). The presence of one or more additional layers in the insole 500 may depend on the type of article of footwear utilizing the insole 500. For example, a running or other athletic shoe may include one or more additional layers for enhanced cushioning. Conversely, an article of footwear for rehab or enhanced tactile feedback may not include the one or more additional layers within the insole 500.

The insole 500 can include a third layer 506. In some examples, the third layer 506 can be an inner-most layer of the insole 500 (top-most layer shown in FIGS. 14-17). The third layer 506 is disposed against the inward-facing side 516 of the first layer 502. Specifically, an outward-facing side 558 (or surface) of the third layer 506 is disposed against (in face-to-face contact with) the inward-facing side 516 of the first layer 502.

The third layer 506 comprises a plurality of spaced apart domes 560 that follow a contour of the plurality of domes 512 of the first layer 502. For example, when the insole 500 is assembled (as shown in FIGS. 14-17), each dome 560 of the third layer 506 can overlay or be disposed directly overtop a respective dome 512 of the first layer 502.

The third layer 506 can be formed from a single piece of material. As such, the plurality of domes 560 can be formed in the material of the third layer 506 and spaced apart by a connecting portion 562 of the third layer 506. Each dome 560 protrudes outward and away from the connecting portion 562 in an undeflected state (the first state of the domes 512). Said another way, the domes 560 can be raised relative to the connecting portion 562, on an inward-facing side 564 (or surface) of the third layer 506.

In some examples, the domes 560 of the third layer 506 can be formed by recesses in the outward-facing side 558 (such that the outward-facing side 558 follows a contour of the domes 512) and the inward-facing side 564 of the third layer 506 can be flat (instead of contoured). In this way, the inward-facing side 564 or surface of the third layer 506 can have the appearance of a standard sockliner.

In some examples, the material of the third layer 506 is shape set to conform to the shape of the domes 512 of the first layer, thereby forming the domes 560 shown in FIGS. 14-17.

In some examples, the third layer 506 comprises a textile. In some examples, the textile is a mesh fabric.

In some examples, a tension of the textile of the third layer 506 can be varied to either promote or resist deflection of the domes 512 of the first layer 502. For example, when the textile of the third layer 506 is tighter, the third layer 506 may resist deflection of the domes 512. In comparison, if the textile of the third layer 506 is looser, the third layer 506 may not resist the deflection of the domes 512, thereby enabling the domes 512 to move more freely between the first and second states.

As shown in FIGS. 16A and 16B, as the force 132 (e.g., the wearer's bodyweight) is applied to a portion of the insole 500, a dome 560 can be depressed into a respective dome 512, thereby depressing the respective dome 512 into a respective dome 540 of the second layer 504. During deflection to the second state and return to the first state, the dome 560 can follow the contour of and be disposed against the respective dome 512.

In some examples, the third layer 106 can have a thickness in a range of 0.5-1.5 mm.

In some examples, the insole 500 can comprise an additional layer (for example, an additional layer comprising foam) on the inward-facing side 564 of the third layer 506. As explained above, the presence of one or more additional layers in the insole 500 may depend on the type of article of footwear utilizing the insole 500. For example, a running or other athletic shoe may include one or more additional layers for enhanced cushioning. Conversely, an article of footwear for rehab or enhanced tactile feedback may not include the one or more additional layers within the insole 500.

Edges of one or more layers of the insole 500 form a periphery, i.e., a peripheral boundary, of the insole 500. In some examples, edges of at least the first layer 502 form the peripheral boundary of the insole 500. In some examples, edges of the first layer 502 and the second layer 504 from the peripheral boundary of the insole 500.

In some examples, edges of the insole 500 can comprise an edge treatment, such as seam tape, to enhance adherence of the layers to one another.

In some examples, one or more of the layers 504 and/or 506 can be omitted from the insole 500.

In some examples, the insole 500 (or sockliner) can be formed by forming a rolled good or assembly of all the stacked layers of the insole 100 and then die cutting the assembly into the desired overall shape of the insole 500. As such, different sizes for the insole 500 (or sockliner) can be formed from a same stacked roll of assembled layers.

In some examples, one or more layers of the insole 500 can be formed separately and then coupled together. For example, in some instances, the first layer 502, second layer 504, and/or third layer 506 can be bonded to one another with an adhesive, such as a pressure-sensitive adhesive (PSA).

In some examples, the first layer 502 and the second layer 504 can be molded as one unitary part.

Figure 19:
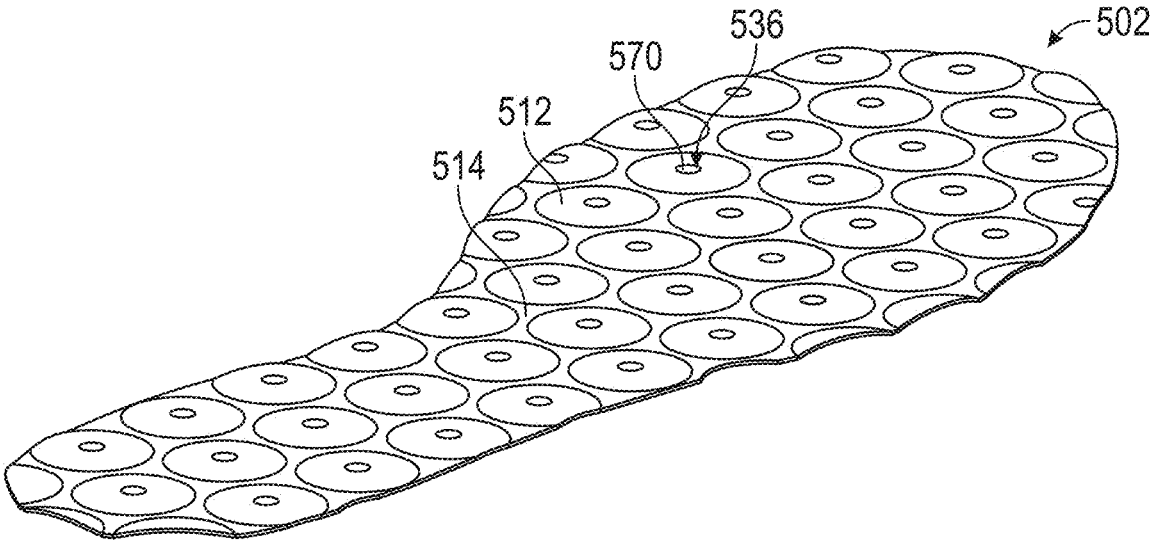
FIG. 19 is a perspective view of a layer for an insole, such as the insole of FIG. 14, where one or more domes of the layer comprise a protrusion at an apex of the dome that is configured to isolate or enhance tactile feedback to the wearer.

In some examples, as shown in FIG. 19, one or more of, or each of, the domes 512 of the first layer 502 can comprise an outwardly extending protrusion 570 (or a bump) at their apex 536. The protrusions 570 are configured to isolate pressure (or tactile sensation) more precisely to a bottom of the wearer's foot. This may increase the tactile sensation experienced by the wearer. The protrusions 570 can be formed into the first layer 502 (i.e., formed as one unitary piece), attached separately to the domes 512, or formed within a separate layer placed on top of or against the inward-facing side 516 of the first layer 502.

In some examples, any of the insoles described herein can be adapted for use in an article of footwear having a sole structure including a sole member and sensory node assembly configured to provide tactile feedback to the wearer of the article of footwear, such as any of the sole structures described in U.S. patent application Ser. No. 18/940,251, which is incorporated by reference herein.

Figure 20:
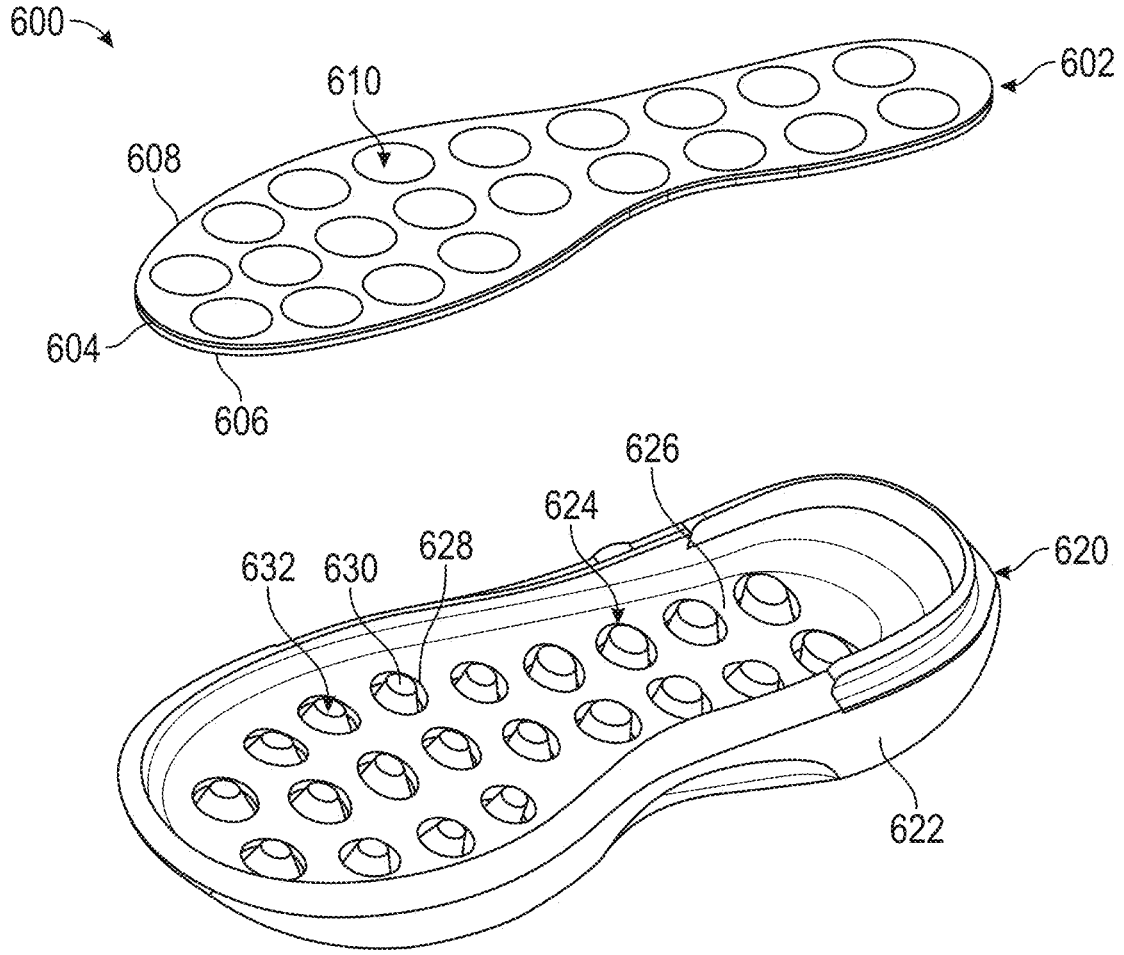
FIG. 20 is an exploded view of an exemplary sole structure for an article of footwear, where the sole structure includes an insole similar to the insole of FIG. 14 and a sole member.

For example, FIG. 20 is an exploded view of a sole assembly 600 for an article of footwear (such as the article of footwear 400 shown in FIG. 11) that includes an insole 602 and a sole structure 620. The insole 602 can be similar to the insole 500 of FIGS. 14-18 (or FIG. 19), except the domes in the various layers are positioned and sized to match the position and size of the apertures 628 and/or sensory nodes 630 in the underlying sole structure 620. For example, the insole can comprise a first layer 602 (which can correspond to the first layer 502 of FIG. 14), a second layer 606 (which can correspond to the second layer 504 of FIG. 14), and a third layer 608 (which can correspond to the third layer 506 of FIG. 14).

In some examples, the insole 602 can be replaced with any of the other insoles described herein, such as the insole 100, insole 200, or insole 300. Further, in some examples, the insole 600 can include more or less layers than shown in FIG. 20, such as described herein.

The sole structure 620 comprises a sole member 622 and a sensory node assembly 624. The sole member 622 is adapted to receive the sensory node assembly 624. In some examples, the sole member 622 can be a midsole. In some examples, the sole member 622 can be an outsole. The sensory node assembly 624 comprises a plurality of individual sensory nodes 630 that provide a tactile response to variations in a ground surface and/or as different parts of the sole structure 620 engage the ground surface when worn by an individual.

The sole member 622 comprises a plurality of spaced apart apertures 628 defined by walls or sidewalls of the sole member 622. Each sensory node 630 is arranged within and configured to translate freely (e.g., move up and down) within a respective aperture 628. Further details on the sole structure 620, and other sole structures comprising a sensory node assembly can be found in U.S. patent application Ser. No. 18/940,251.

The insole 602 can be adapted based on a shape and arrangement of the sole member 622 and sensory node assembly 624 of the sole structure 620. For example, the domes 610 in the third layer 608, the underlying domes in the first layer 604 (which may be similar to the domes 512 of the insole 500), and the underlying domes in the second layer 606 (which may be similar to the domes 540 in the insole 500) can be shaped and positioned across the insole 500 to correspond to (or match) the location of respective apertures 628 in the sole member 622 and/or sensory nodes 630 in the sensory node assembly 624. More specifically, each dome assembly of the insole 600 (comprising a respective dome 610 and underlying domes of the first layer 604 and second layer 606) can be aligned with and overlay a respective sensory node 630 when the insole 602 is mated with (positioned against) the inward-facing surface 626 of the sole member 622. The dome assemblies of the insole 600 can be shaped and/or sized to match the respective apertures 628 and/or sensory nodes 630. In this way, tactile sensation can be increased to the wearer from the combination of the sensory nodes 630 and domes of the first layer 604 of the insole 600.

The insole 602, or any of the other insoles described herein, can be positioned against and/or coupled to the inward-facing surface 626 of the sole member 622, thereby forming the sole assembly 600. In some examples, each sensory node 630 has a first end 632 (as shown in FIG. 20) that is coupled directly to the insole 600 when the insole 602 is positioned against the inward-facing surface 626 of the sole member 622.

In some examples, the sole assembly 600 can be coupled to an upper, such as the upper 404 of FIG. 11. For example, in some instances, the sole assembly 600 can be used in lieu of the sole structure 402 and insole 100 in the article of footwear 400 (e.g., the insole 602 can replace the insole 100 and the sole structure 620 can replace the sole structure 402).

Any of the technologies herein could be applied to an article of apparel other than insoles, such as gloves, shoulder straps, seat of pants, or the like. For example, an article of apparel can include the layers 102, 104, 106, 108, and 110 (or some sub-combination thereof) of the insole 100, but shaped as the target portion of the article of apparel instead of an insole-shape.

Additional Examples of the Disclosed Technology

Additional examples of the disclosed technology are enumerated below.

Example 1. An insole for an article of footwear, comprising: a sheet forming a portion of the insole, the sheet comprising a plurality of domes that are spaced apart from one another and interconnected by a connecting portion of the sheet, wherein the connecting portion extends between adjacent domes and around each dome, and wherein each dome is deflectable from a first state where at least a peak of the dome protrudes in a first direction, away from the connecting portion and a first side of the sheet, to a second state where at least the peak protrudes in a second direction, away from the connecting portion and a second side of the sheet, wherein the second direction is opposite the first direction and the second side is opposite the first side.

Example 2. The insole of any example herein, particularly example 1, wherein in the first state each dome is convex relative to the first side of the sheet, and wherein in the second state each dome is concave relative to the first side of the sheet.

Example 3. The insole of any example herein, particularly examples 1 or 2, wherein the sheet comprises a polymer.

Example 4. The insole of any example herein, particularly example 3, wherein the polymer is polycarbonate.

Example 5. The insole of any example herein, particularly any one of examples 1-4, wherein the sheet comprises a material having an elasticity that is configured such that each dome is deflectable from the first state to the second state in response to a force applied to the dome in the first direction, and wherein each dome snaps back to the first state from the second state in response to removal of the force.

Example 6. The insole of any example herein, particularly any one of examples 1-5, wherein the sheet has a thickness in a range of 0.3-0.45 mm.

Example 7. The insole of any example herein, particularly any one of examples 1-6, wherein the plurality of domes is arranged across a length and width of at least a portion of the insole.

Example 8. The insole of any example herein, particularly example 7, wherein the at least the portion is a majority portion of the insole.

Example 9. The insole of any example herein, particularly examples 7 or 8, wherein the at least the portion is an entirety of the insole.

Example 10. The insole of any example herein, particularly any one of examples 1-9, wherein the sheet is a first layer of the insole, and the plurality of domes are a plurality of first domes, and further comprising a second layer comprising foam that is disposed against the first side of the sheet, wherein the second layer comprises a plurality of spaced apart second domes that follow a contour of the plurality of first domes.

Example 11. The insole of any example herein, particularly example 10, wherein the second layer comprises a top cloth over the foam.

Example 12. The insole of any example herein, particularly any one of examples 1-11, wherein the sheet is a first layer of the insole, and further comprising a third layer comprising a plurality of apertures that are spaced apart from one another and that align with the plurality of domes, wherein a first side of the third layer is disposed against the second side of the sheet.

Example 13. The insole of any example herein, particularly example 12, wherein the third layer has a thickness in a range of 0.38-0.64 mm.

Example 14. The insole of any example herein, particularly examples 12 or 13, further comprising a fourth layer disposed against a second side of the third layer that is opposite the first side of the third layer, and wherein in the second state of each dome, at least the peak of the dome extends into a corresponding aperture of the plurality of apertures toward a first side of the fourth layer that faces the second side of the third layer.

Example 15. The insole of example 14, wherein in the second state of each dome, at least the peak of the dome extends into the corresponding aperture and contacts the first side of the fourth layer.

Example 16. The insole of any example herein, particularly example 14 or example 15, wherein the fourth layer comprises PETG.

Example 17. The insole of any example herein, particularly any one of examples 14-16, further comprising a fifth layer disposed against a second side of the fourth layer that is opposite the first side of the fourth layer, wherein the fifth layer comprises a textile.

Example 18. The insole of any example herein, particularly example 17, wherein the textile is a knit, woven, or non-woven textile.

Example 19. The insole of any example herein, particularly examples 17 or 18, wherein the textile is a felt.

Example 20. An article of footwear comprising the insole of any one of examples 1-19 and 46-48, and further comprising an upper including a strobel, and wherein the insole is arranged inside the upper and against the strobel.

Example 21. The article of footwear of any example herein, particularly example 20, further comprising an outsole coupled to the upper.

Example 22. An insole for an article of footwear, comprising: a first layer comprising a plurality of domes spaced apart from one another across the first layer; and a second layer disposed adjacent to the first layer, wherein the second layer comprises a plurality of apertures spaced apart from one another, wherein each dome of the first layer is aligned with a corresponding aperture of the plurality of apertures of the second layer, and wherein each dome has an undeflected state wherein the dome protrudes outward and away from the corresponding aperture and a deflected state wherein the dome extends into the corresponding aperture.

Example 23. The insole of any example herein, particularly example 22, wherein edges of the first layer and the second layer form a peripheral boundary of the insole.

Example 24. The insole of any example herein, particularly examples 22 or 23, wherein the first layer comprises a polymer and has a thickness in a range of 0.3-0.45 mm such that each dome is configured to move from the undeflected state to the deflected state under an applied load and return to the undeflected state from the deflected state when the applied load is removed.

Example 25. The insole of any example herein, particularly example 24, wherein the thickness of the first layer is in a range of 0.35-0.41 mm.

Example 26. The insole of any example herein, particularly examples 24 or 25, wherein the polymer is polycarbonate.

Example 27. The insole of any example herein, particularly any one of examples 22-26, wherein edges of the plurality of domes are interconnected by connecting segments that are continuous across the first layer.

Example 28. The insole of any example herein, particularly example 27, further comprising a third layer disposed adjacent to the second layer, wherein in the undeflected state each dome protrudes away from the connecting segments in a first direction, and wherein in the deflected state each dome protrudes away from the connecting segments in a second direction toward the third layer.

Example 29. The insole of any example herein, particularly example 28, wherein the third layer is planar and comprises a polymer.

Example 30. The insole of any example herein, particularly examples 28 or 29, further comprising a fourth layer disposed adjacent to the third layer, wherein the fourth layer comprises a textile.

Example 31. The insole of any example herein, particularly example 30, wherein the textile is a knit, woven, or non-woven textile.

Example 32. The insole of any example herein, particularly example 31, wherein the non-woven textile is a felt.

Example 33. The insole of any example herein, particularly any one of examples 22-32, wherein each dome has a diameter in a range of 18-22 mm.

Example 34. The insole of any example herein, particularly any one of examples 22-33, wherein, in the undeflected state, each dome has a height, in a direction normal to a plane of the insole, in a range of 1.4-1.6 mm, wherein the height is measured from a foot-facing surface of the first layer, at a connecting portion of the first layer that interconnects the plurality of domes, to a peak of the dome.

Example 35. An insole for an article of footwear, comprising: a first layer comprising a plurality of spaced apart domes formed therein, wherein each dome is movable between a convex shape and a concave shape relative to an inward-facing side of the first layer that faces an interior of the article of footwear, and wherein the first layer comprises a polymer having an elasticity such that each dome is movable from the convex shape to the concave shape under a load and returns to the convex shape when the load is removed; and a second layer comprising foam, wherein the second layer is disposed over the inward-facing side of the first layer, and wherein the second layer follows a contour of the plurality of spaced apart domes.

Example 36. The insole of any example herein, particularly example 35, wherein the first layer comprises a continuous connecting portion that extends between adjacent domes and around each dome of the plurality of spaced apart domes, and wherein in the convex shape each dome protrudes away from the connecting portion in a first direction and in the concave shape each dome protrudes away from the connecting portion in a second direction that is opposite the first direction.

Example 37. The insole of any example herein, particularly examples 35 or 36, wherein the first layer has a thickness of 0.3-0.45 mm.

Example 38. The insole of any example herein, particularly examples 35-37, wherein the first layer has a thickness of 0.38 mm.

Example 39. The insole of any example herein, particularly any one of examples 35-38, further comprising a third layer disposed against the first layer, on an outward-facing side of the first layer that is opposite the inward-facing side, wherein the third layer comprises a plurality of spaced apart apertures, and wherein each dome is configured to extend into a corresponding aperture of the plurality of spaced apart apertures in its concave shape.

Example 40. The insole of any example herein, particularly example 39, wherein the third layer comprises polyethylene terephthalate glycol.

Example 41. The insole of any example herein, particularly examples 39 or 40, further comprising a fourth layer disposed against the third layer, on an outward-facing side of the third layer, and wherein the fourth layer is planar and comprises a polymer.

Example 42. The insole of any example herein, particularly examples 39 or 40, further comprising a fourth layer disposed adjacent an outward-facing side of the third layer, and wherein the fourth layer is planar and comprises a textile.

Example 43. The insole of any example herein, particularly any one of examples 35-42, wherein the first layer comprises polycarbonate.

Example 44. The insole of any example herein, particularly any one of examples 22-34, wherein the first and second layers form portions of the insole.

Example 45. The insole of any example herein, particularly any one of examples 35-43, wherein the first and second layers form portions of the insole.

Example 46. The insole of any example herein, particularly any one of examples 1-19, wherein the sheet is a first sheet, further comprising a second sheet comprising a plurality of cut-outs forming a plurality of protrusions extending outward from a connecting portion of the second sheet, and wherein the second sheet is attached to the first sheet such that a free end of each protrusion is attached to a respective dome of the plurality of domes.

Example 47. The insole of any example herein, particularly example 46, wherein the second sheet comprises leather.

Example 48. The insole of any example herein, particularly example 46, wherein the second sheet comprises rubber.

Example 49. The insole of any example herein, particularly any one of examples 22-34, further comprising a fifth layer disposed between the first layer and the second layer, and wherein the fifth layer comprises a flexible material that is configured to dampen resonance of the plurality of domes as each dome moves between the undeflected state and the deflected state.

Example 50. The insole of any example herein, particularly example 49, wherein the fifth layer comprises a plurality of cut-outs forming a plurality of protrusions that extend outward from a connecting portion of the fifth layer, wherein each cut-out extends around a perimeter of a respective dome of the plurality of domes, and wherein a free end of a corresponding protrusion is attached to a center of the respective dome.

Example 51. The insole of any example herein, particularly examples 39 or 40, further comprising a fourth layer disposed adjacent an outward-facing side of the third layer, and wherein the fourth layer comprises rubber.

Example 52. The insole of any example herein, particularly any one of examples 39-42 or 51, further comprising a fifth layer disposed between the first layer and the third layer, wherein the fifth layer comprises a plurality of spaced apart cut-outs forming a plurality of protrusions extending outward from a connecting portion of the fifth layer, wherein each cut-out extends around a respective dome of the plurality of domes, and wherein a corresponding protrusion formed by the cut-out is bonded to a peak of the respective dome.

Example 53. The insole of any example herein, particularly any one of examples 1-5, wherein the sheet is a first layer of the insole, and the plurality of domes are a plurality of first domes, and further comprising a second layer comprising a textile that is disposed against the first side of the sheet, wherein the second layer comprises a plurality of spaced apart second domes that follow a contour of the plurality of first domes.

Example 54. The insole of any example herein, particularly any one of examples 1-6, wherein the sheet is a first layer of the insole, the plurality of domes are a plurality of first domes, and the connecting portion in a first connecting portion; and further comprising a third layer comprising a plurality of second domes that are spaced apart from one another and interconnected by a connecting portion, wherein each second dome is aligned with a respective first dome of the plurality of first domes and surrounded by a plurality of apertures in the third layer that are spaced apart around a perimeter of the second dome, wherein a first side of the third layer is disposed against the second side of the sheet.

Example 55. The insole of any example herein, particularly example 7, wherein the second connecting portion has a thickness defined between the first side of the third layer and a second side of the third layer that is opposite the first side of the third layer, and wherein each second dome is deflectable from a first state where at least a peak of the second dome protrudes in the first direction, away from the second connecting portion on the first side of the third layer, to a second state where at least the peak of the second dome protrudes in the second direction, into a respective cavity of a plurality of cavities that are defined by the plurality of apertures and the thickness of the second connecting portion.

Example 56. The insole of any example herein, particularly example 8, wherein in the second state of each first dome, at least the peak of the first dome extends into a respective cavity of the plurality of cavities in the third layer.

Example 57. An insole for an article of footwear, comprising a first layer comprising a plurality of first domes spaced apart from one another across the first layer; and a second layer disposed adjacent to the first layer, wherein the second layer comprises a plurality of second domes spaced apart from one another across the second layer, each second dome aligned with a respective first dome of the plurality of first domes; a connecting portion extending between and around the plurality of second domes; and a plurality of apertures extending through a thickness of the connecting portion, wherein each second dome is surrounded by one or more apertures of the plurality of apertures which define a respective cavity underneath the second dome having a depth defined by the thickness of the connecting portion, wherein each respectively aligned first dome and second dome has an undeflected state and a deflected state, wherein the first and second domes protrude outward and away from the respective cavity in the undeflected state, and wherein the first and second domes extend into the respective cavity in the deflected state.

Example 58. The insole of any example herein, particularly example 57, wherein edges of the first layer and the second layer form a peripheral boundary of the insole.

Example 59. The insole of any example herein, particularly either example 57 or example 58, wherein the first layer comprises a polymer and has a thickness in a range of 0.3-0.45 mm such that each first dome is configured to move from the undeflected state to the deflected state under an applied load and return to the undeflected state from the deflected state when the applied load is removed.

Example 60. The insole of any example herein, particularly any one of examples 57-59, wherein edges of the plurality of first domes are interconnected by connecting segments that are continuous across the first layer.

Example 61. The insole of any example herein, particularly example 60, wherein the first layer is disposed against a first side of the second layer, wherein in the undeflected state, each first dome protrudes away from the connecting segments in a first direction and each second dome protrudes away from the connecting portion in the first direction, and wherein in the deflected state, each first dome protrudes away from the connecting segments in a second direction toward a second side of the second layer that is opposite the first side and each second dome protrudes into the respective cavity toward the second side of the second layer.

Example 62. The insole of any example herein, particularly any one of examples 57-61, wherein each first dome has a diameter in a range of 18-22 mm.

Example 63 The insole of any example herein, particularly any one of examples 57-62, wherein in the undeflected state each first dome has a height, in a direction normal to a plane of the insole, in a range of 1.4-1.6 mm, wherein the height is measured from a foot-facing surface of the first layer, at a connecting portion of the first layer that interconnects the plurality of domes, to a peak of the dome.

Example 64. An insole for an article of footwear, comprising a first layer comprising a plurality of spaced apart first domes formed therein, wherein each first dome is movable between a convex shape and a concave shape relative to an inward-facing side of the first layer that faces an interior of the article of footwear, and wherein the first layer comprises a polymer having an elasticity such that each first dome is movable from the convex shape to the concave shape under a load and returns to the convex shape when the load is removed; and a second layer comprising a connecting portion and a plurality of spaced apart second domes, wherein each second dome is connected to the connecting portion by one or more connectors that are defined by one or more apertures that are spaced apart around a perimeter of the second dome, wherein the one or more apertures extend through a thickness of the connecting portion and define a respective cavity underneath the second dome, and wherein each second dome is aligned with a respective first dome of the plurality of first domes and is movable, with the respective first dome, between a convex shape and a concave shape relative to an inward-facing side of the connecting portion of the second layer that faces the first layer, wherein each respective first dome and second dome are configured to extend into the respective cavity in their concave shapes, and wherein the second layer is configured to attenuate sound as each first dome moves between the convex and concave shape.

Example 65. The insole of any example herein, particularly example 64, further comprising a third layer arranged against the inward-facing side of the first layer, wherein the third layer comprises a textile and follows a contour of the plurality of spaced apart first domes.

Example 66. The insole of any example herein, particularly either example 64 or example 65, wherein the first layer comprises a continuous connecting portion that extends between adjacent first domes and around each first dome of the plurality of spaced apart first domes, and wherein in the convex shape each first dome protrudes away from the connecting portion of the first layer in a first direction and in the concave shape each first dome protrudes away from the connecting portion of the first layer in a second direction that is opposite the first direction.

Example 67. The insole of any example herein, particularly any one of examples 64-66, wherein each first dome is movable between a concave shape and a convex shape relative to an outward-facing side of the first layer that is opposite the inward-facing side, wherein each second dome is movable, with the respective first dome, between a concave shape and a convex shape relative to an outward-facing side of the connecting portion that is opposite the inward-facing side of the connecting portion, and wherein each respective first dome and second dome are configured to extend into the respective cavity in their convex shapes relative to the respective outward-facing sides.

Example 68. An article of footwear comprising the insole of any example herein, and further comprising a sole structure comprising a sole member and a sensory node assembly, wherein the sole member comprises a plurality of spaced apart apertures extending through the sole member, and wherein the sensory node assembly comprises a plurality of individual sensory nodes, wherein each sensory node extends through a respective aperture of the plurality of spaced apart apertures, and wherein the sensory nodes of the plurality of sensory nodes are not attached to the sole member and are freely movable relative to each other and the sole member, wherein the insole is coupled to an inward-facing surface of the sole member.

Example 69. The article of footwear of example 68, further comprising an upper, wherein the sole structure is coupled to the upper.

Example 70. The article of footwear of either example 68 or example 69, wherein each sensory node has a first end coupled directly to the insole and an opposite, second end configured to engage with a ground surface.

Example 71. The insole of any example herein, particularly example 1, wherein in the first state each dome is concave relative to the second side of the sheet, and wherein in the second state each dome is convex relative to the second side of the sheet.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. An insole for an article of footwear, comprising: a first sheet forming a portion of the insole, the first sheet comprising a plurality of domes that are spaced apart from one another and interconnected by a connecting portion of the first sheet, wherein the connecting portion extends between adjacent domes and around each dome, and wherein each dome is deflectable from a first state where at least a peak of the dome protrudes in a first direction, away from the connecting portion and a first side of the first sheet, to a second state where at least the peak protrudes in a second direction, away from the connecting portion and a second side of the first sheet at the connecting portion, wherein the second direction is opposite the first direction and the second side is opposite the first side; and a second sheet disposed adjacent the second side of the first sheet, the second sheet comprising a plurality of cavities, wherein each cavity is aligned with a respective dome of the plurality of domes.

2. The insole of claim 1, wherein in the first state each dome is convex relative to the first side of the first sheet, and wherein in the second state each dome is concave relative to the first side of the first sheet.

3. The insole of claim 1, wherein the first sheet comprises polycarbonate.

4. The insole of claim 1, wherein the first sheet comprises a material having an elasticity that is configured such that each dome is deflectable from the first state to the second state in response to a force applied to the dome in the second direction, and wherein each dome snaps back to the first state from the second state in response to removal of the force.

5. The insole of claim 1, wherein the plurality of domes is arranged across a length and width of at least a portion of the insole.

6. The insole of claim 1, wherein the plurality of domes of the first sheet are a plurality of first domes, and further comprising a third sheet comprising a textile that is disposed against the first side of the first sheet, wherein the third sheet comprises a plurality of spaced apart third domes that follow a contour of the plurality of first domes.

7. The insole of claim 1, wherein the plurality of domes are a plurality of first domes and the connecting portion in a first connecting portion, and wherein the second sheet comprises a plurality of second domes that are spaced apart from one another and interconnected by a second connecting portion, wherein each second dome is aligned with a respective first dome of the plurality of first domes and surrounded by a plurality of apertures in the second sheet that are spaced apart around a perimeter of the second dome, and wherein each cavity of the plurality of cavities is formed underneath a respective second dome and defined by the plurality of apertures and a thickness of the second connecting portion.

8. The insole of claim 7, wherein the thickness of the second connecting portion is defined between the first side of the second sheet and a second side of the second sheet that is opposite the first side of the second sheet, and wherein each second dome is deflectable from a first state where at least a peak of the second dome protrudes in the first direction, away from the second connecting portion on the first side of the second sheet, to a second state where at least the peak of the second dome protrudes in the second direction, into a respective cavity of the plurality of cavities.

9. The insole of claim 8, wherein in the second state of each first dome, at least the peak of the first dome extends into a respective cavity of the plurality of cavities in the second sheet.

10. An article of footwear comprising the insole of claim 1, and further comprising an upper including a strobel, and wherein the insole is arranged inside the upper and against the strobel.

11. An insole for an article of footwear, comprising:

a first layer comprising a plurality of first domes spaced apart from one another across the first layer; and a second layer disposed adjacent to the first layer, wherein the second layer comprises:

a plurality of second domes spaced apart from one another across the second layer, each second dome aligned with a respective first dome of the plurality of first domes;

a connecting portion extending between and around the plurality of second domes; and a plurality of apertures extending through a thickness of the connecting portion, wherein each second dome is surrounded by one or more apertures of the plurality of apertures which define a respective cavity underneath the second dome having a depth defined by the thickness of the connecting portion, wherein each respectively aligned first dome and second dome has an undeflected state and a deflected state, wherein the first and second domes protrude outward and away from the respective cavity in the undeflected state, and wherein the first and second domes extend into the respective cavity in the deflected state.

12. The insole of claim 11, wherein edges of the first layer and the second layer form a peripheral boundary of the insole.

13. The insole of claim 11, wherein the first layer comprises a polymer and has a thickness in a range of 0.3-0.45 mm such that each first dome is configured to move from the undeflected state to the deflected state under an applied load and return to the undeflected state from the deflected state when the applied load is removed.

14. The insole of claim 11, wherein edges of the plurality of first domes are interconnected by connecting segments that are continuous across the first layer.

15. The insole of claim 14, wherein the first layer is disposed against a first side of the second layer, wherein in the undeflected state, each first dome protrudes away from the connecting segments in a first direction and each second dome protrudes away from the connecting portion in the first direction, and wherein in the deflected state, each first dome protrudes away from the connecting segments in a second direction toward a second side of the second layer that is opposite the first side and each second dome protrudes into the respective cavity toward the second side of the second layer.

16. The insole of claim 11, wherein each first dome has a diameter in a range of 18-22 mm.

17. The insole of claim 11, wherein in the undeflected state each first dome has a height, in a direction normal to a plane of the insole, in a range of 1.4-1.6 mm, wherein the height is measured from a foot-facing surface of the first layer, at a connecting portion of the first layer that interconnects the plurality of domes, to a peak of the dome.

18. An insole for an article of footwear, comprising:

a first layer comprising a plurality of spaced apart first domes formed therein, wherein each first dome is movable between a convex shape and a concave shape relative to an inward-facing side of the first layer that faces an interior of the article of footwear, and wherein the first layer comprises a polymer having an elasticity such that each first dome is movable from the convex shape to the concave shape under a load and returns to the convex shape when the load is removed; and a second layer comprising a connecting portion and a plurality of spaced apart second domes, wherein each second dome is connected to the connecting portion by one or more connectors that are defined by one or more apertures that are spaced apart around a perimeter of the second dome, wherein the one or more apertures extend through a thickness of the connecting portion and define a respective cavity underneath the second dome, and wherein each second dome is aligned with a respective first dome of the plurality of first domes and is movable, with the respective first dome, between a convex shape and a concave shape relative to an inward-facing side of the connecting portion of the second layer that faces the first layer, wherein each respective first dome and second dome are configured to extend into the respective cavity in their concave shapes, and wherein the second layer is configured to attenuate sound as each first dome moves between the convex and concave shape.

19. The insole of claim 18, further comprising a third layer arranged against the inward-facing side of the first layer, wherein the third layer comprises a textile and follows a contour of the plurality of spaced apart first domes.

20. The insole of claim 18, wherein the first layer comprises a continuous connecting portion that extends between adjacent first domes and around each first dome of the plurality of spaced apart first domes, and wherein in the convex shape each first dome protrudes away from the connecting portion of the first layer in a first direction and in the concave shape each first dome protrudes away from the connecting portion of the first layer in a second direction that is opposite the first direction.

* * * * *